United States Patent [19]

Horsey et al.

[11] Patent Number: 4,856,722

[45] Date of Patent: Aug. 15, 1989

[54] APPARATUS AND PROCESS FOR AUTOMATICALLY TAKING UP A CONTINUOUSLY SUPPLIED YARN

[75] Inventors: Robert W. Horsey, Kanata; Laurent C. Pilon; Grant M. Fletcher, both of Arnprior; Arland W. Horner, Kanata, all of Canada

[73] Assignee: BASF Fibres, Inc., Arnprior, Canada

[21] Appl. No.: 268,680

[22] Filed: Nov. 7, 1988

Related U.S. Application Data

[63] Continuation of Ser. No. 107,724, Oct. 8, 1987, abandoned.

[51] Int. Cl.[4] ..... B65H 67/044

[52] U.S. Cl. ..... 242/18 A; 242/18 PW

[58] Field of Search ..... 242/18 A, 18 PW, 18 DD, 242/18 R, 35.5 R, 35.5 A, 25 A

[56] References Cited

U.S. PATENT DOCUMENTS

| | | | |
|---|---|---|---|
| 2,957,635 | 10/1960 | Bisbe | 242/18 A |
| 3,521,826 | 7/1970 | Schmick | 242/18 A |
| 3,682,403 | 8/1972 | Willis | 242/18 A |
| 3,876,161 | 4/1975 | Miller | 242/18 A |
| 3,908,918 | 9/1975 | Bergstrom | 242/18 R |
| 3,915,398 | 10/1975 | Corl | 242/35.5 A |
| 4,023,741 | 5/1977 | Schar | 242/18 R |
| 4,052,017 | 10/1977 | Schar | 242/35.5 A |
| 4,069,983 | 1/1978 | Muramatsu et al. | 242/18 PW |
| 4,079,898 | 3/1978 | Murakami et al. | 242/35.5 A |
| 4,083,505 | 4/1978 | Burkhardt | 242/18 PW |
| 4,114,820 | 9/1978 | Lafeber | 242/18 A |
| 4,116,395 | 9/1978 | Courvoisier | 242/35.5 A |
| 4,340,187 | 7/1982 | Schippers et al. | 242/35.5 A |

*Primary Examiner*—Stanley N. Gilreath

*Attorney, Agent, or Firm*—Tom R. Vestal; Edward F. Sherer; Rupert B. Hurley, Jr.

[57] ABSTRACT

An automatic transfer device and process for the transfer of a continuously supplied yarn from a first take-up tube, which usually has a full package thereon, to a second take-up tube, which has usually no yarn thereon. In carrying out this process, the apparatus automatically cuts and aspirates the continuously supplied yarn, and an actuator arm applies the yarn to the second take-up tube by moving the continuously-supplied yarn into contact with a yarn snagging device.

2 Claims, 24 Drawing Sheets

APPARATUS AND PROCESS FOR AUTOMATICALLY TAKING UP A CONTINUOUSLY SUPPLIED YARN

This is a continuation of co-pending application Ser. No. 07/107,724, filed on Oct. 8, 1987, now abandoned.

BACKGROUND OF THE INVENTION

A. Field of the Invention

This invention relates to an apparatus and process for automatically winding of the continuously-supplied yarn.

B. Description of the Prior Art

Modern winders, for winding yarn onto yarn packages on take-up tubes, generally include two or more tube holders, each supporting one or more take-up tubes. While one holder is being rotated for winding yarn onto tubes mounted thereon, empty take-up tubes are placed on a second tube holder then in a standby condition. When full packages have been wound on the first tube, the full package is removed therefrom. It is then necessary to thread the yarn for winding onto the tube on the second tube holder.

The threading of the yarn can be effected by feeding the end of the yarn onto an aspirator or the like, and then using a "doffer" to engage the yarn in traverse guides for proper winding on the tubes. Such rethreading of the yarn requires a considerable amount of time. In addition, such a rethreading procedure produces a considerable amount of waste, particularly when yarns are fed at very high speeds.

Attempts have been proposed to reduce the amount of time required for rethreading yarn. For instance, U.S. Pat. No. 4,083,505 discloses a winding machine with a device for bringing yarn to be applied in operative connection with a driven bobbin and a thread-capturing device so that the yarn is seized and spool formation began independently. One of the problems associated with this device is that thread guides are required which, in turn, must be manually threaded.

The present invention provides an apparatus and process for automatically winding a continuously-supplied yarn.

SUMMARY OF THE INVENTION

The apparatus of the present invention is designed to transfer a winding operation from a first take-up tube, which is full, to a second take-up tube, which is empty. In making this transfer, the apparatus must cut the continuously-supplied yarn in order to remain in control of the continuously-supplied yarn. Control is maintained by aspirating the upstream end of the continuously-supplied yarn. The apparatus must next position an empty take-up tube and apply the continuously-supplied yarn to the empty tube, followed by breaking the yarn so that a waste section of yarn is retained by the aspirator. The apparatus and process of the present invention are designed to apply the yarn to the empty tube and form a "transfer tail" thereon, in order to improve further downstream process operations which utilize the bobbin produced.

The process of the present invention comprises the following steps:

(a) catching a yarn in a yarn catcher, the yarn catcher catching the yarn at a point within a yarn traversing triangle;

(b) cutting the yarn in a yarn cutter;

(c) aspirating the upstream end of the yarn;

(d) moving a first take-up arm from a yarn winding position to a first doff-donn position;

(e) moving a second take-up arm from a second doff-donn position to a yarn-winding position;

(f) moving the path of yarn travel with an actuator means, wherein the continuously-supplied yarn is snagged and held by a yarn snagger, the yarn path then being oriented thereby so that the yarn upstream of the snag point begins to wind upon the second take-up tube;

(g) breaking the yarn at a point downstream of the snag point; and (h) returning the yarn catcher to a nonengaged position.

The apparatus of the present invention comprises a yarn catcher, a yarn cutter, an aspirator, a first take-up arm, a first tube holder, a first take-up tube, a second take-up arm, a second tube holder, a second take-up tube, a rotatable take-up cam, a yarn traversing means, a movable actuator means, a rotatable yarn snagger, and a yarn breaking means.

OBJECTS OF THE INVENTION

It is an object of the present invention to reduce the degree of manual manipulation of a yarn being wound. If the present invention is utilized in its least automated embodiment, the present invention allows an operator to more easily transfer the winding of a continuously supplied yarn from a full bobbin to an empty tube. If the present invention is utilized in its most automated embodiment, no operator is required during the process of transferring the winding of the continuously-supplied yarn from the full bobbin to the empty tube.

It is a further object of the present invention to form a transfer tail for each yarn bobbin in order to improve further downstream process operations.

It is a further object of the present invention to enable the formation of a package of uniform length.

It is a further object of the present invention to make a yarn package having a higher density.

It is a further object of the present invention to enable accurate production records of package numbers, yarn lengths per package, package defect levels, and short and long term machine performance.

It is a further object of the present invention to waste a minimal amount of yarn during the transferring of the winding from a full bobbin to an empty tube.

It is a further object of the present invention to improve the uniformity of transfer tail length among the yarn packages.

DETAILED DESCRIPTION OF THE PREFERRED EMBODIMENTS

The process and apparatus of the present invention are designed to reduce or eliminate manual operations in the process of transferring a continuously-supplied yarn from a first take-up tube to a second take-up tube. Usually, the first take-up tube is full while the second take-up tube is empty. In addition, in the most preferred embodiment of the present invention, which is fully automated, the amount of yarn waste (accumulating during the transfer process) is kept to a minimum. Some other benefits of the most preferred embodiment of the process and apparatus are:

(1) a reduction in operating personnel (in comparison with completely manual transfer processes);

(2) a reduction in the risk of injury to operating personnel, due to the need for fewer manual operations.

FIGS. 1 through 15 illustrate, in perspective view, the apparatus (20) used for carrying out the process of the present invention. The sequence of operations is cyclic, i.e., after the step occurring in FIG. 15, the process continues by carrying out the steps shown in FIG. 1, then FIG. 2, etc. Therefore, in describing the process, one must simply "cut-in" at any particular moment and describe the process from that point onward.

Figure 1:
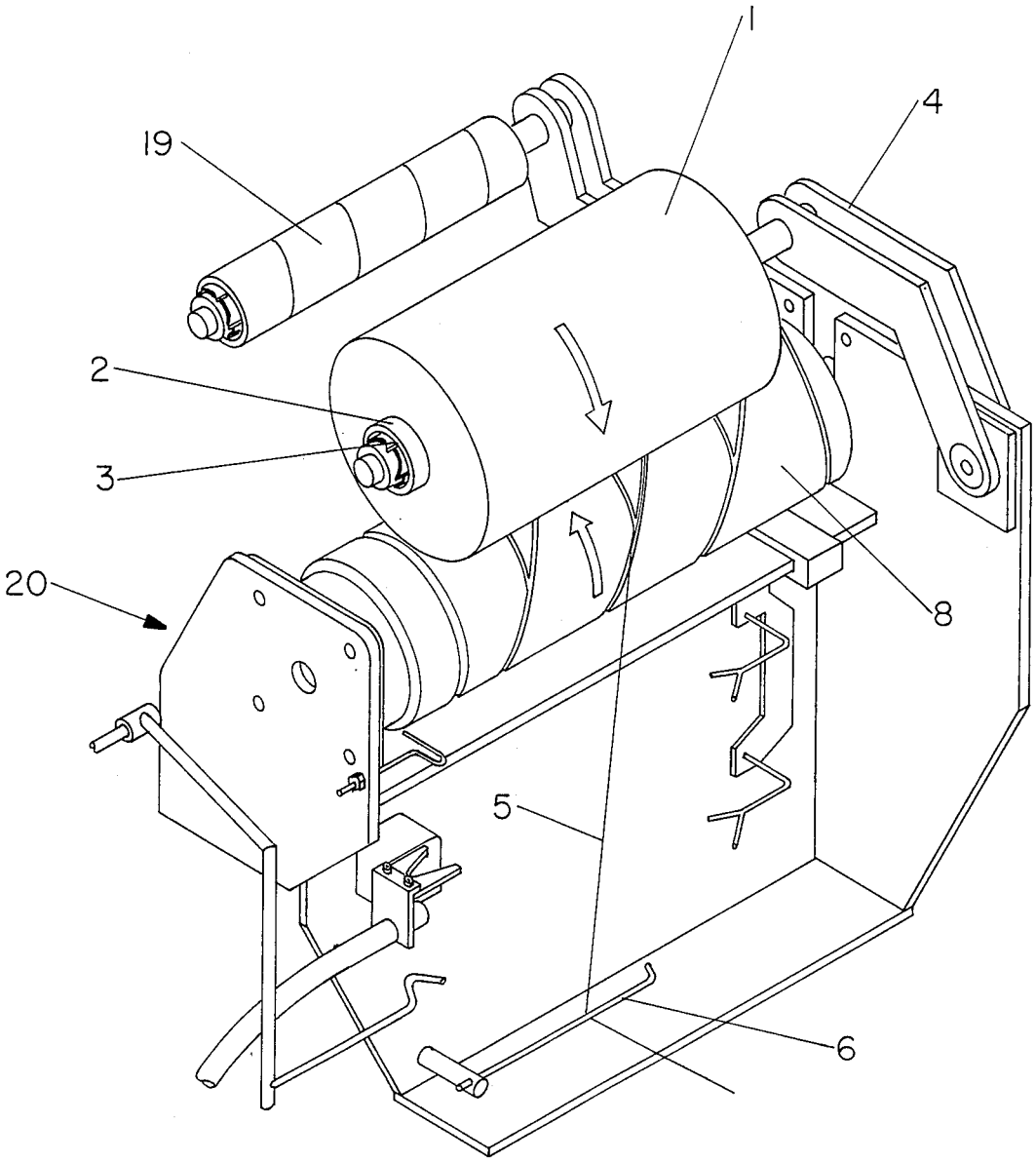
FIGS. 1, 2, 3A, 3B, 4, 5, 6, 7, 8, 9, 10, 11, 12, 13, 14, and 15 illustrate perspective views of the yarn transfer apparatus (20), including the bobbin tubes after they are donned and the full bobbins before they are doffed. These figures illustrate specific points in the yarn transfer process, and it is to be understood that the movements are carried out between the sequential illustrations, not within any single illustration. In other words, the figures are not "steps" of the process but are merely "points" within the process. The figures are sequenced according to the process which the machine may carry out.

FIG. 1 illustrates a point in the cycle of the process in which the winding of a yarn (5) on a first yarn package (1) is nearing completion. The yarn (5) is continuously supplied. Thus, in FIG. 1 the yarn package (1) has just about reached a desired maximum size. The first yarn package (1) is formed on a first take-up tube (2), the first take-up tube being held by a first take-up tube holder (3). The tube holder (3) is freely rotatable and is attached to a first take-up arm (4). FIG. 1 indicates that the yarn (5) is coming from a source of continuous supply (not shown), the yarn being threaded under a yarn traverse guide bar (6) and into the helical grooves of a traverse roll (8), after which the yarn is wound onto the surface of the first yarn package (1).

Figure 2:
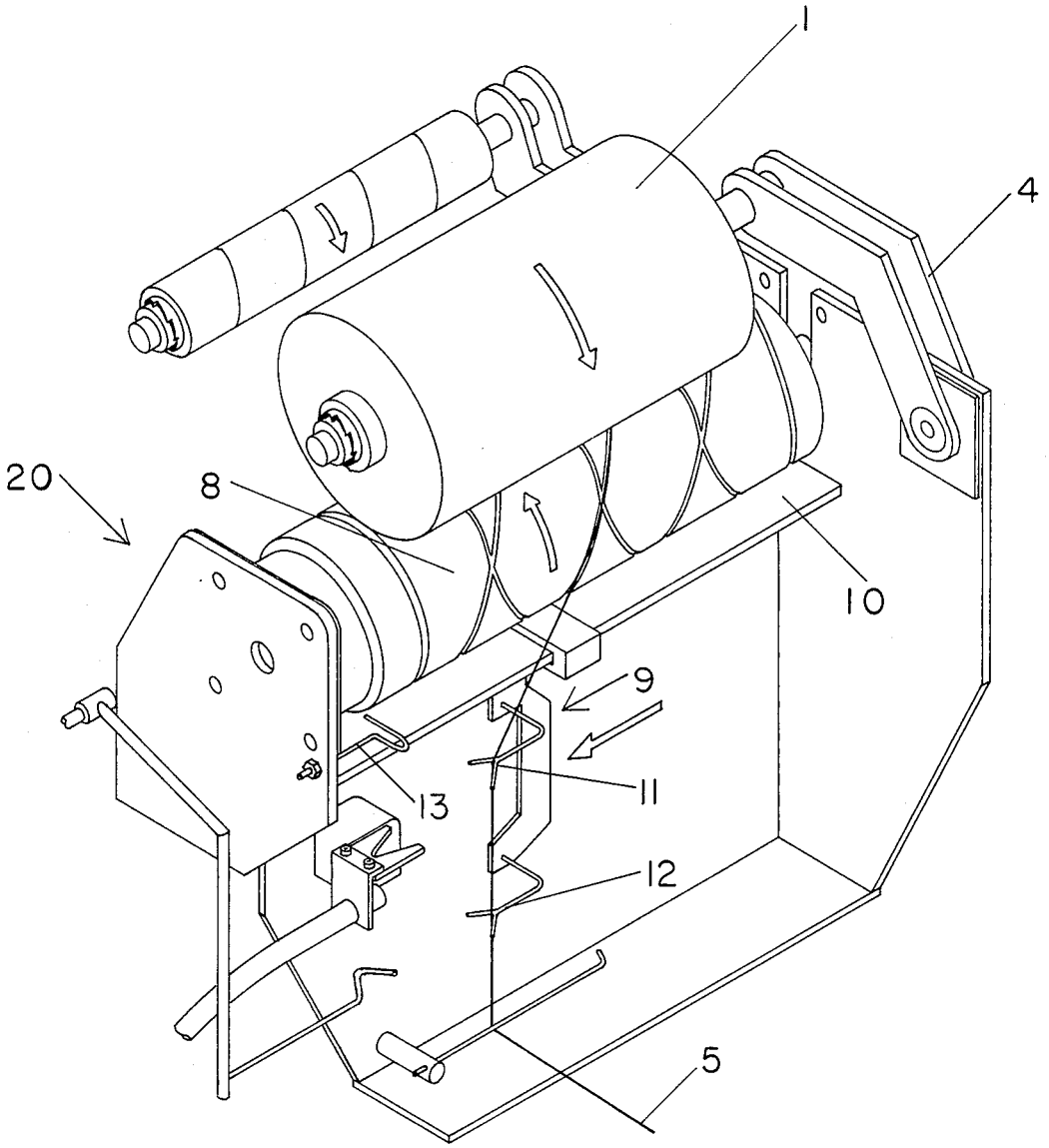
Figure 3A:
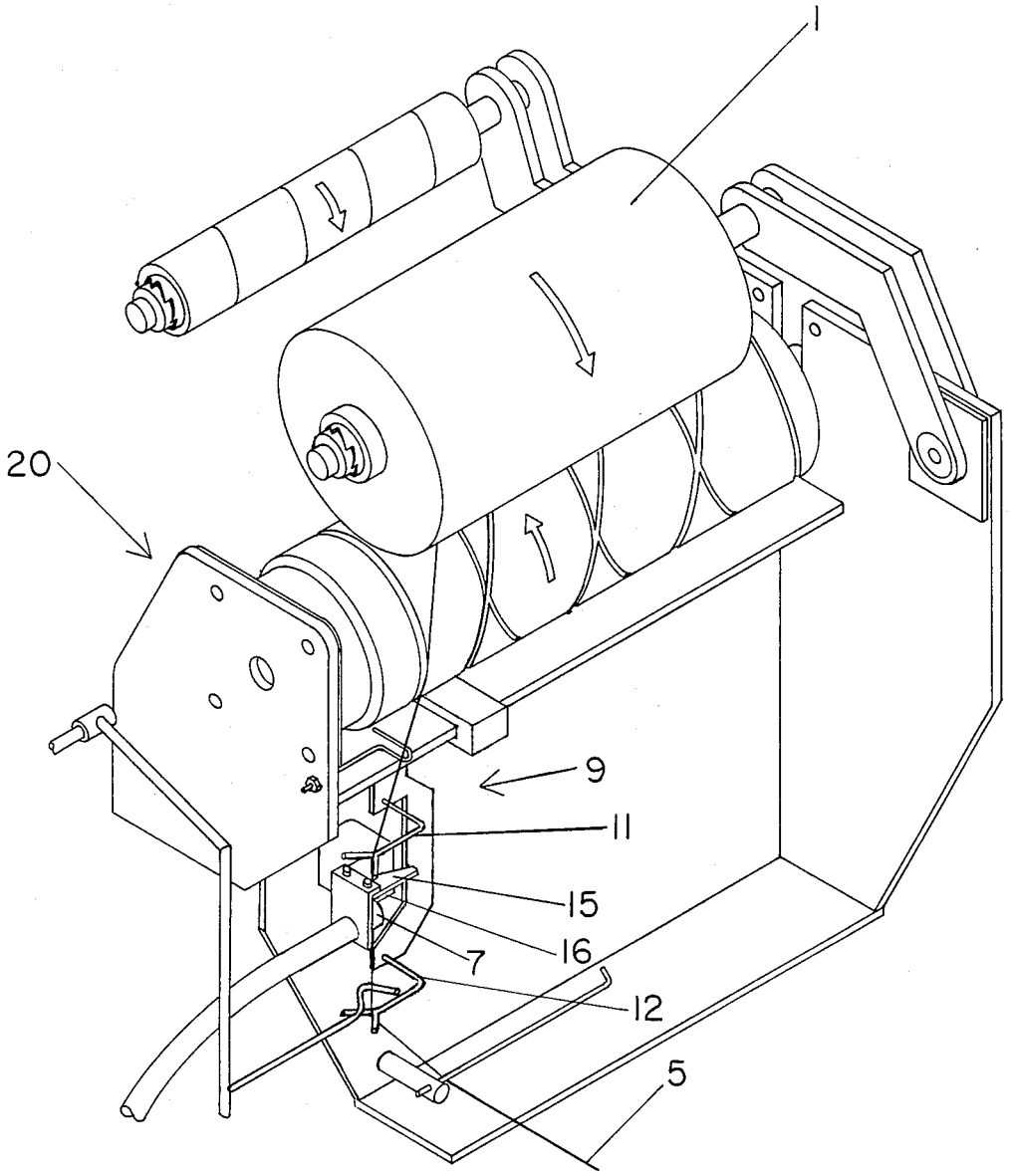
Figure 19A:
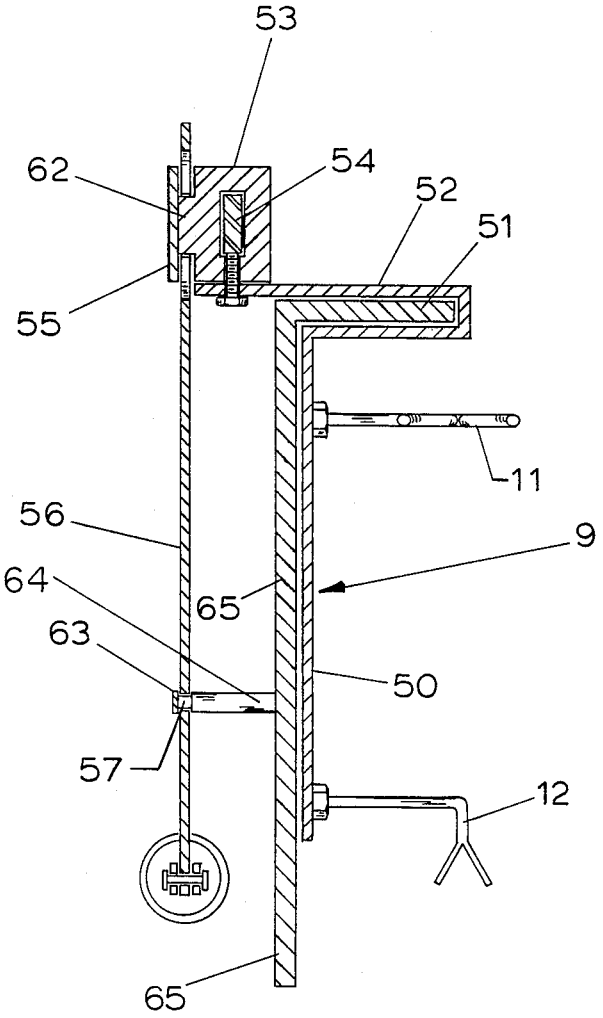
FIG. 19A illustrates an enlarged cross sectional view of the yarn catcher assembly and supporting members therefor, this view being taken from a position which is in the plane of movement of the yarn catcher assembly.
Figure 19B:
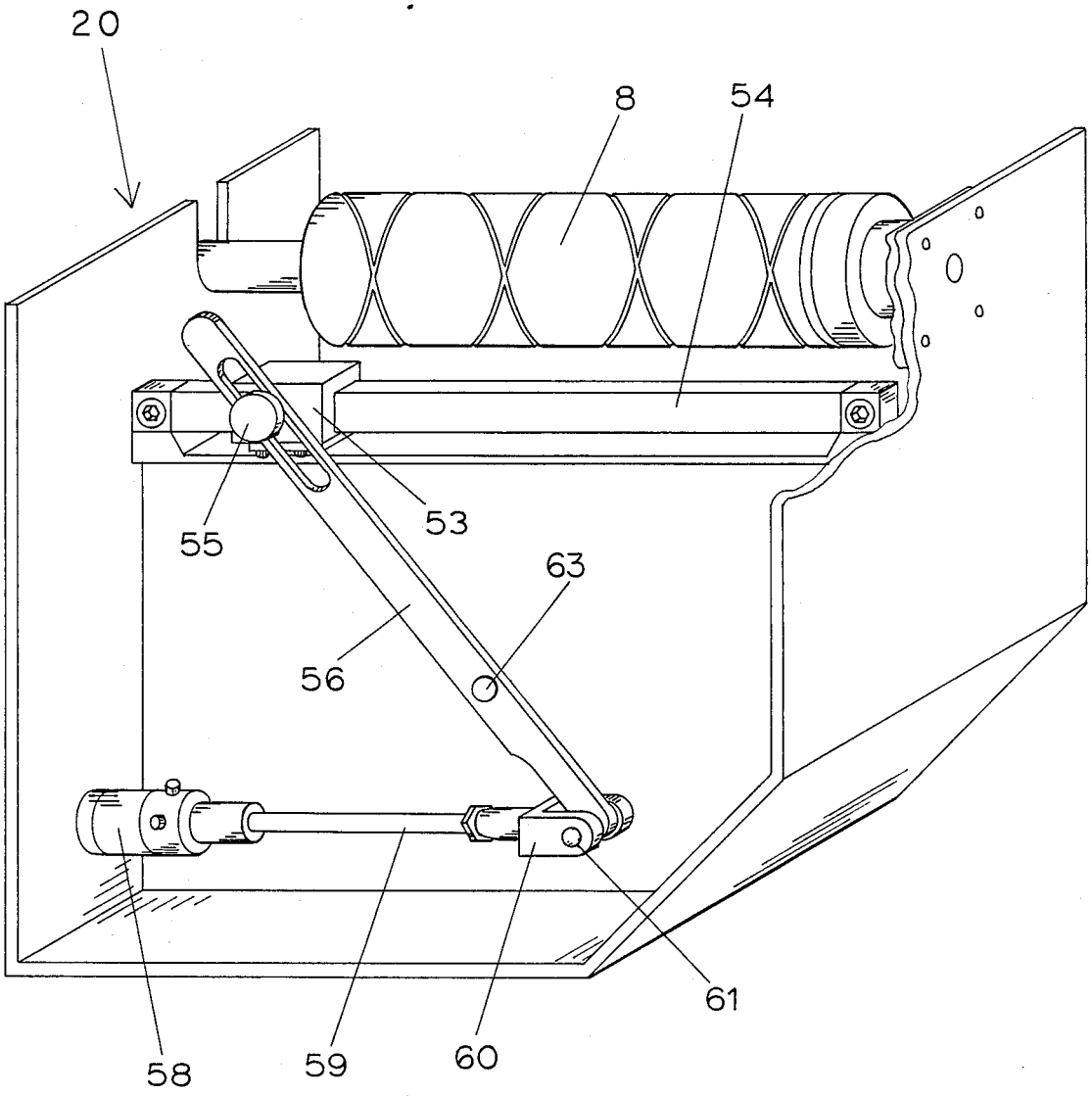
FIG. 19B is a "backside" perspective cutaway view of the mechanism which moves the yarn catcher assembly from its non-engaged position to its engaged position, and vice versa.

A second point in the process is illustrated in FIG. 2. Once the first yarn package (1) reaches a desired size, a yarn catcher assembly (9) slides across the machine (20) in a direction which is parallel to the axis of the traverse roll (8), the yarn catcher assembly (9) sliding from a nonengaged position (FIG. 1) to an engaged position (FIG. 3A). The yarn catcher slides from the side of the machine (20) on which the take-up arm (4) is mounted to the opposite side of the machine (20). The yarn catcher assembly (9) is suspended from and slides on a yarn catcher guide bar (54, as shown in FIG. 19A and 19B) the guide bar (54) being rectangular in cross-section. The yarn catcher assembly (9) has thereon a lower yarn-contact member (12) and an upper yarn-contact member (11), each of these members being positioned to intersect the yarn path upon catcher assembly (9) moving from the nonengaged position to the engaged position. As it is shown in FIG. 2, the yarn-catcher assembly (9) is in transit from the nonengaged position to the engaged position. In FIG. 2, the catcher assembly has gone about sixty percent of the way across, and has caught the traveling yarn (5) with yarn contact members (11) and (12). [NOTE: In FIG. 2, it appears as if a yarn transfer guide (13) might obstruct the movement of yarn (5) when the catcher assembly (9) moves into the engaged position. This is only an illusion, as the transfer guide (13) is well in front of the yarn contact members (11) and (12), and the yarn (5).]

Figure 3B:
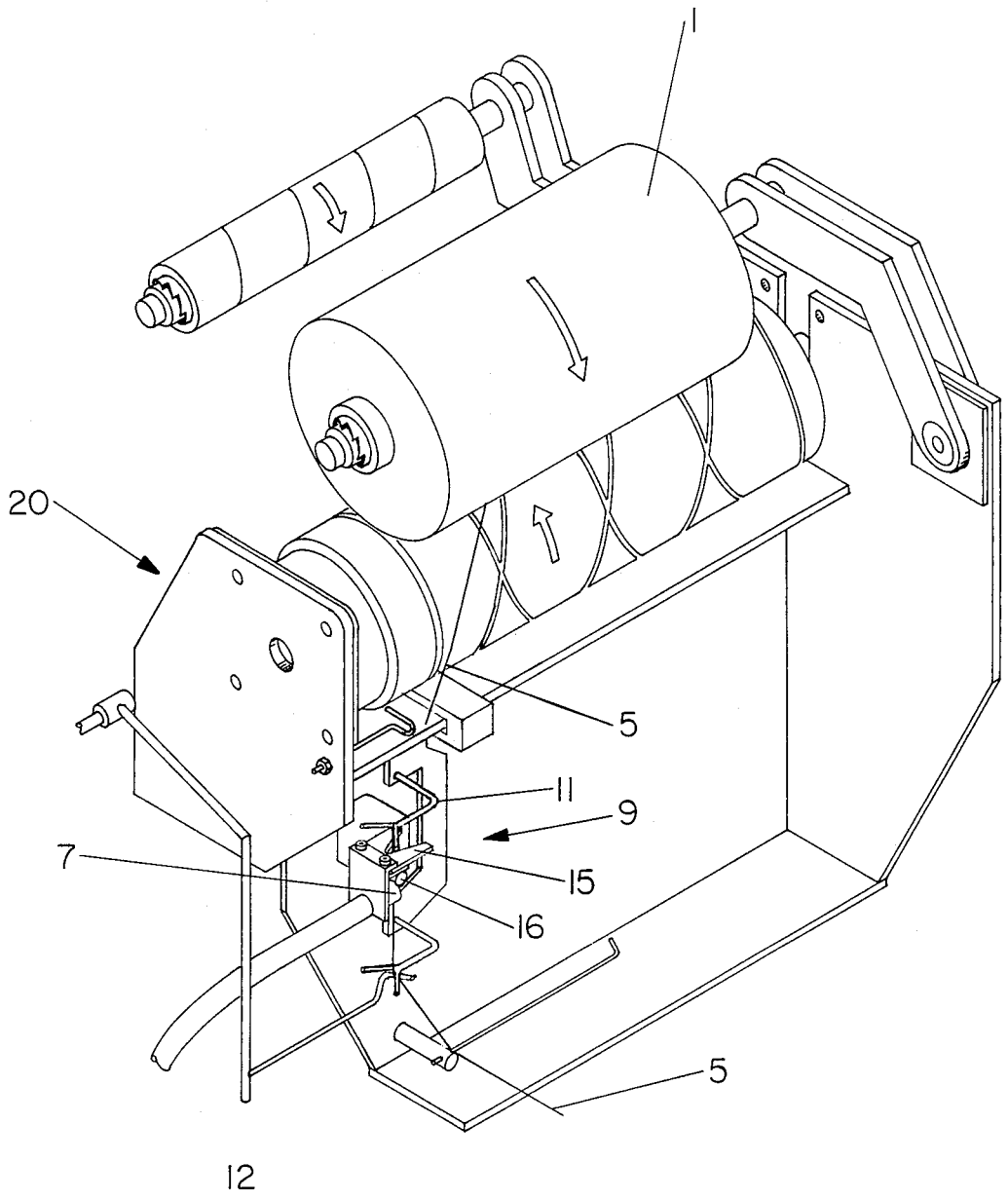
Figure 17:
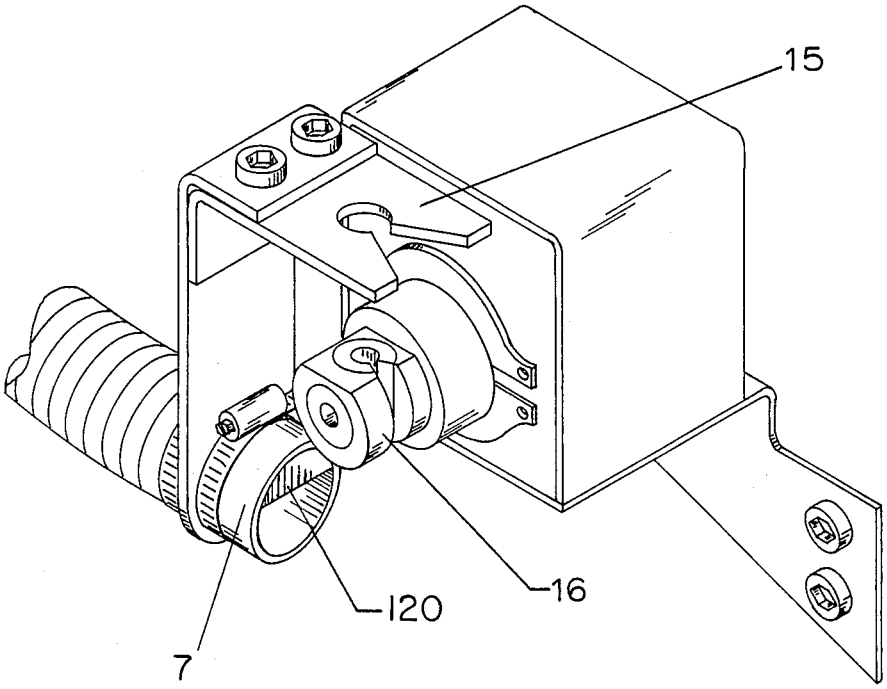
FIG. 17 illustrates an enlarged perspective view of a yarn cutter and an aspirator which are utilized in the process and device of the present invention.

FIG. 3A illustrates a next point in the cyclic process. The yarn contact members (11) and (12) hold a section of traveling yarn in a substantially straight line therebetween. When the yarn catcher assembly (9) slides into the engaged position, this straight section of traveling yarn is held in a position so that the yarn is forced into a yarn cutter guide (15) and a yarn cutter (16), as clearly shown in FIG. 17, and an upstream portion of the straight section of yarn which is held between members 11 and 12 [i.e., a portion of the straight section of yarn immediately below the cutter (16), as shown in FIG. 17] is forced into the proximity of an aspirator (7) which is taking in air at a high rate of speed. After achieving this position momentarily, an automatic device actuates the electronic yarn cutter (16), resulting in the process as depicted in FIG. 3B. It should be understood that FIG. 3B is a high speed "stop-action" illustration of what the inventors conceive of the yarn looking like immediately after the cutting process. In FIG. 3B, the upstream portion of the yarn (5) has just entered into an aspirator (7) and the downstream portion of the yarn (5) is free to finish winding on the first yarn package (1).

Figure 4:
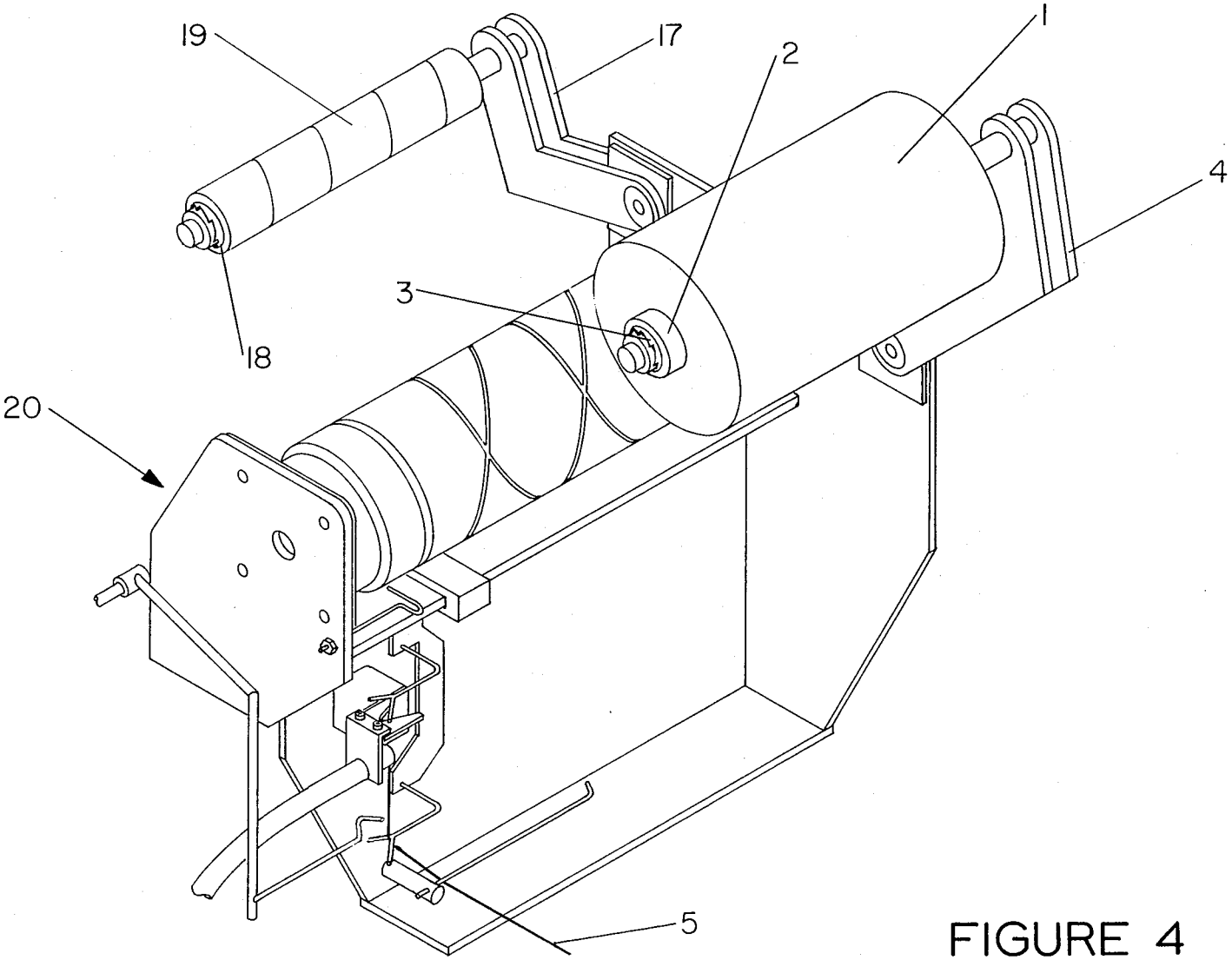
Figure 20:
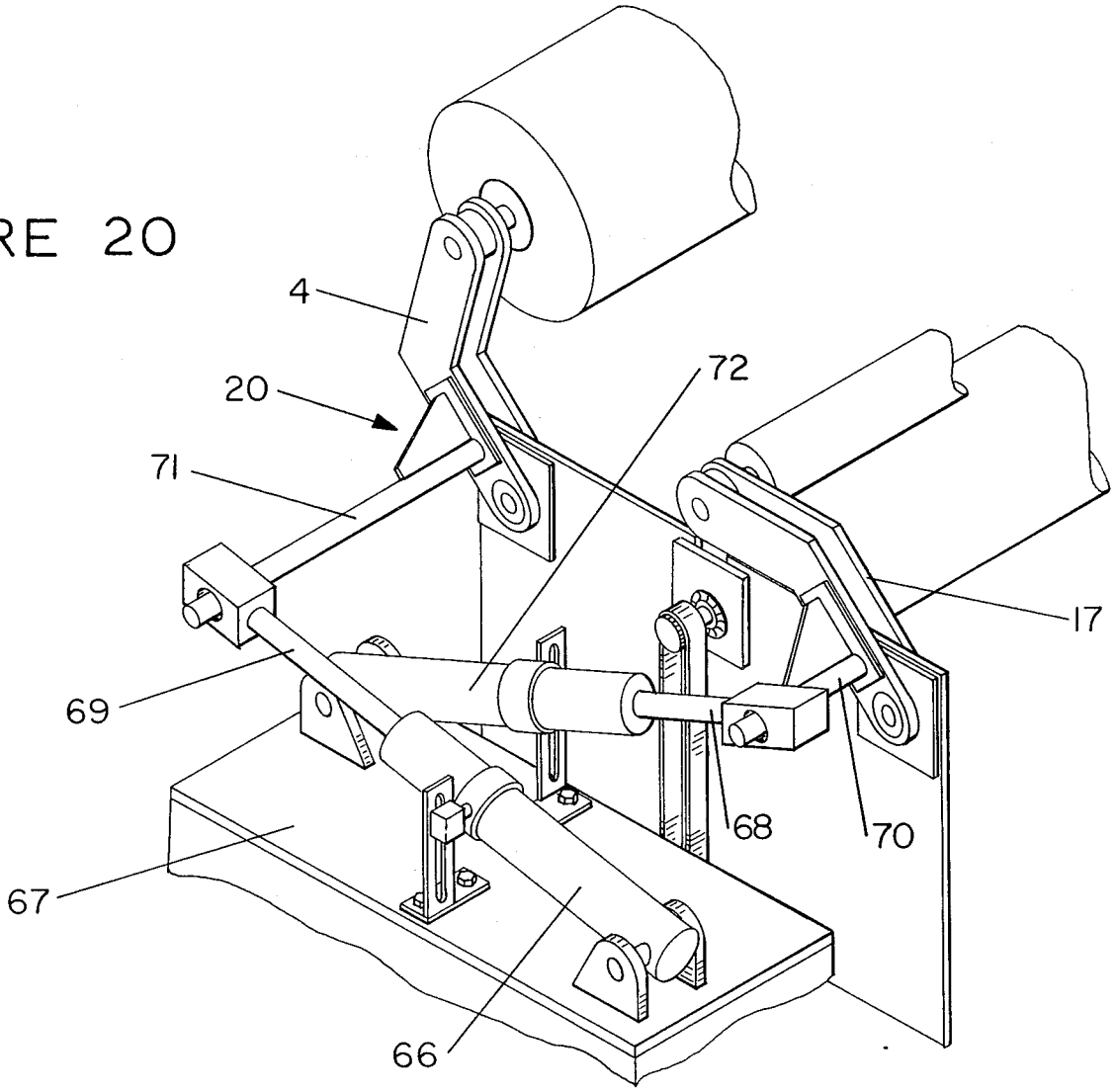
FIG. 20 is a "backside" perspective view of the mechanisms which move both of the take-up arms from their respective yarn-winding positions to their respective doff-donn positions.
Figure 22:
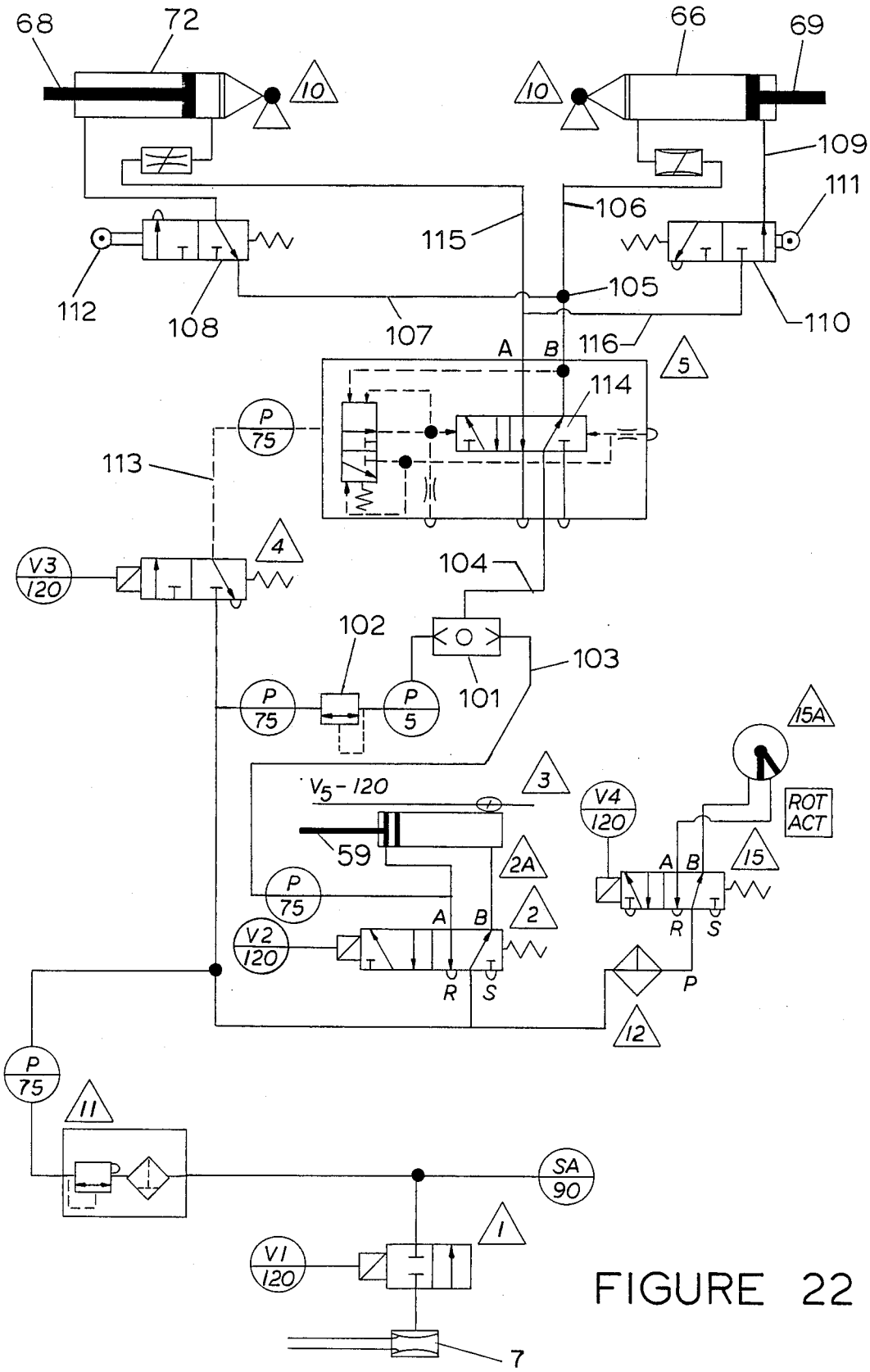
FIG. 22 is a schematic of the pneumatic circuitry which powers and coordinates the movement of the various movable components on the yarn transfer apparatus.

FIG. 4 illustrates a next point in the process. Note that in comparing FIG. 3B with FIG. 4, the first take-up arm (4) has been swung away from the yarn-winding position (FIG. 3B) to the doff-donn position (FIG. 4). In the most preferred embodiment, the swinging of the arm (4) is performed by pneumatic piston means, the piston being automatically actuated. [For clarity of illustration, pneumatic pistons are not shown in FIGS. 1 through 15; however, the pistons are shown in FIGS. 20 and 22]. In FIG. 4, a second take-up arm (17) is shown, the second arm (17) being now only partially obscured by the first yarn package. The second take-up arm (17) has a second tube holder (18) [tube holders (18) and (3) are better illustrated in FIG. 18]. The second tube holder (18) has a second take-up tube (19) thereon. The second tube holder (18) and the second take-up tube (19) are both identical to the corresponding first tube holder (3) and the first take-up tube (2). However, the second take-up arm (17) is the mirror image of the first take-up arm (4).

Figure 5:
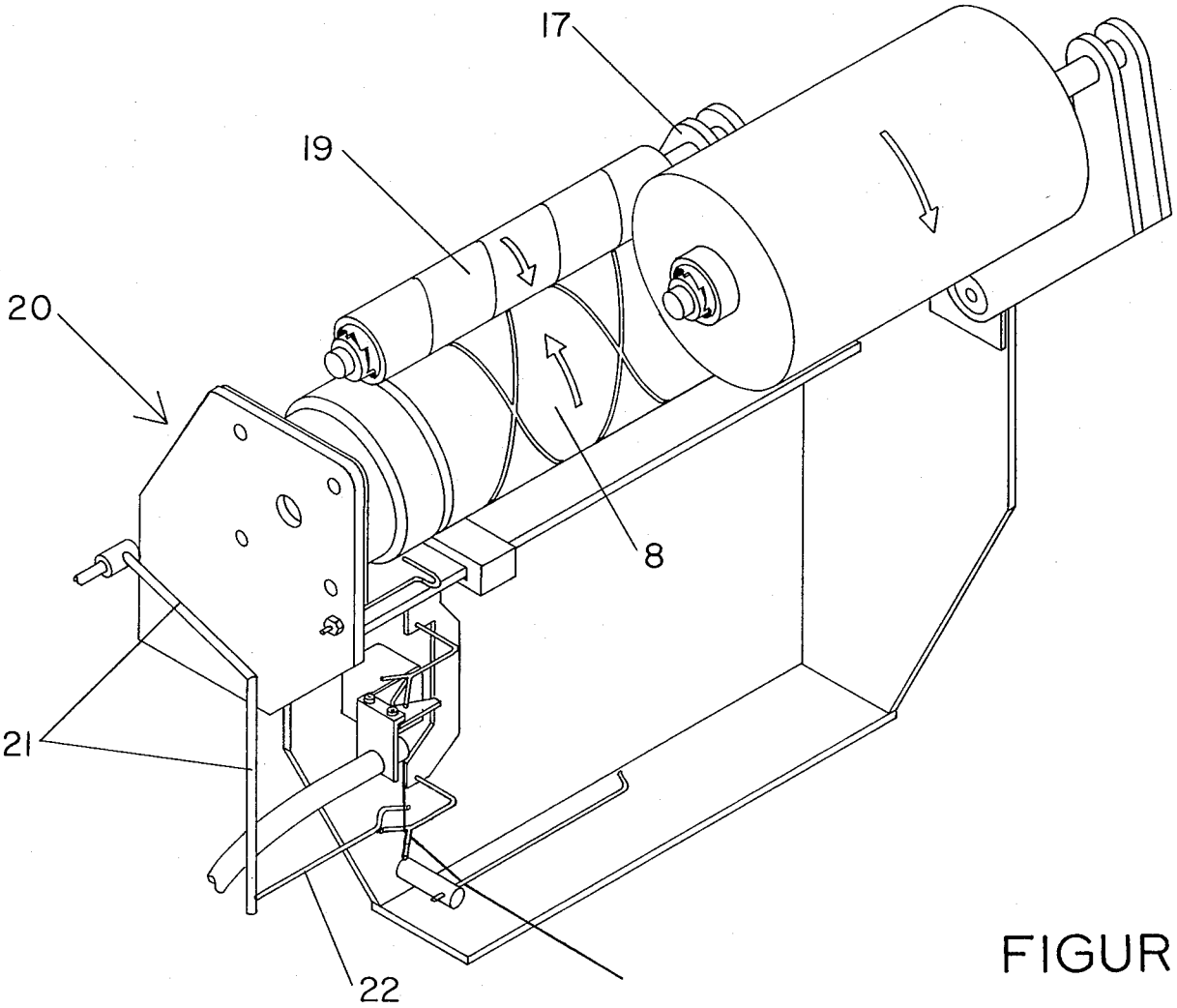

In FIG. 5, a next point in the process is shown. The second take-up arm (17) has been moved from a doffdonn position (FIG. 4) to a yarn-winding position (FIG. 5). During the steps depicted by FIGS. 1 through 15, the traverse roll (8) never ceases to spin at the desired winding speed. Thus, upon applying the second take-up tube (19) to the traverse roll (8), the tube (19) immediately receives power from the rotating traverse roll (8), the tube (19) quickly coming to match the surface speed of the rotating traverse roll (8).

Figure 6:
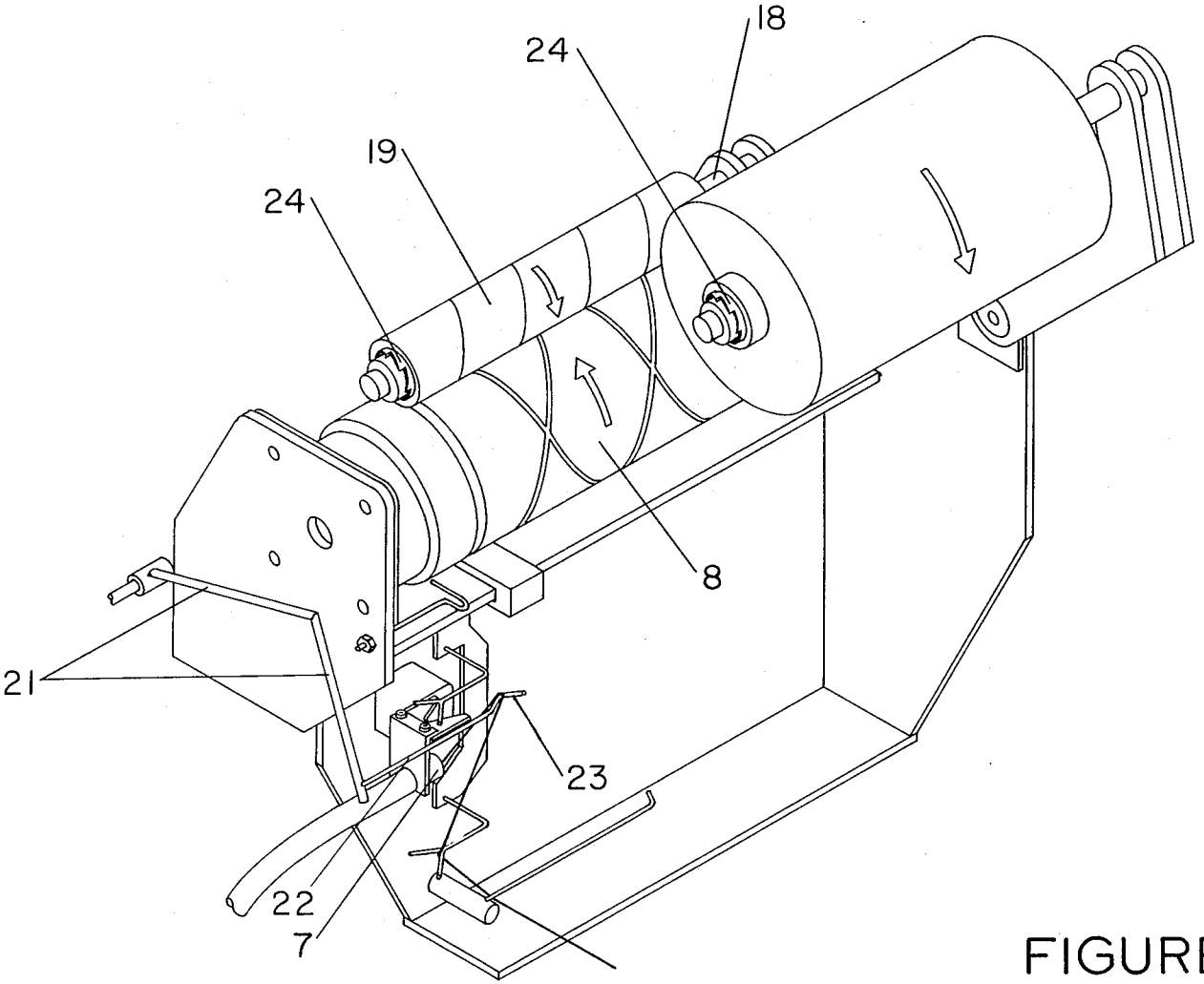

In FIG. 6, the next step of the process has begun. After the surface speed of the second take-up tube (19) has matched the surface speed of the traverse roll (8), an actuator lever (21) rotates counter-clockwise in a quick motion. FIG. 6 is a stop-action view as the lever has made about 50% of its counter-clockwise rotation. The actuator lever (21) is in the inactive position as shown in FIG. 5, the inactive position being "at about five o'clock" in the most preferred embodiment. In FIG. 6, the lever is "at about 3 o'clock", and in FIG. 7 the actuator lever is in the active position, a position which is "at about one o'clock". The actuator lever (21) has an actuator arm (22) thereon. The actuator arm (22) has a hook (23) therein, the hook (23) being positioned so that the continuously-supplied yarn, which is being aspirated, is held therein during the rotation of the actuator lever.

Figure 7:
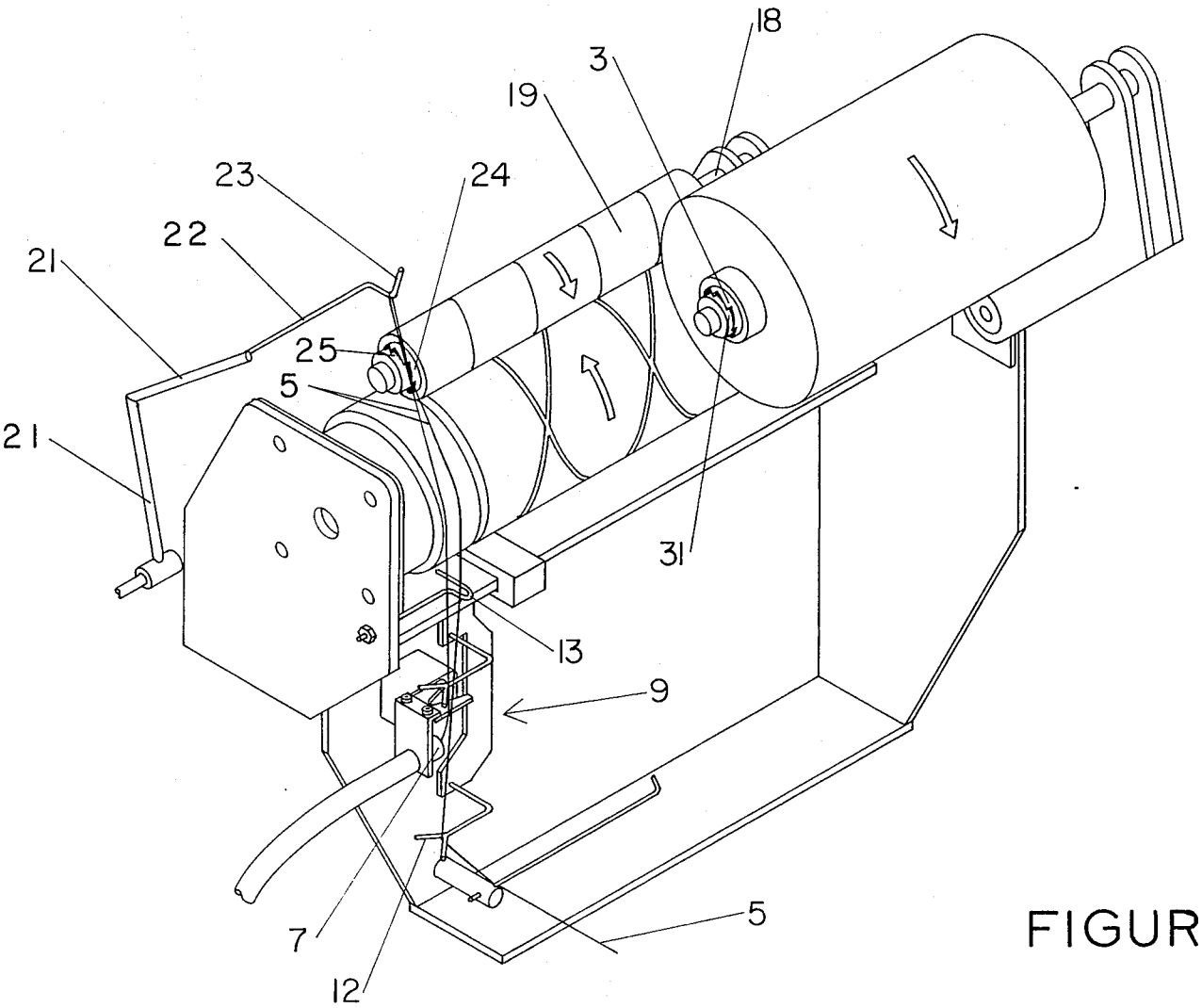

FIG. 7 shows the actuator lever (21) upon completion of its counter-clockwise motion. The yarn (5) loops over the actuator arm (22), the yarn being positioned in the hook (23) on the actuator arm. The motion of the actuator lever (21) causes the path of yarn travel to be moved—i.e., altered. When the actuator lever (21) is in the nonengaged position (i.e., the "5 o'clock" position), the arm (22) is positioned completely out of the way of the yarn (5) during the normal yarn winding operation. However, once the yarn is being aspirated, the yarn path is in a position to be affected by the arm (22) upon a counter-clockwise rotation of the actuator lever (21), if the actuator lever is in the inactive position, as it should be at this point (i.e., as shown in FIG. 5). Once the actuator lever (21) has rotated counter-clockwise a few degrees from the inactive position, the yarn (5) is contacted by the hook (23), and the yarn path to the aspirator is thereby altered by the further rotation of the actuator lever (21) as shown in FIG. 6. Thus, the path of yarn travel is moved. The movement of the path of yarn travel is initiated from a point in space, that point in space being the point at which the yarn contacts the hook (23) located on the actuator arm (22). Of course, this "point in space" changes with the movement of the actuator arm (22). The yarn path is moved both upstream and downstream of the point in space. The yarn path is moved between a last point of restrictive yarn contact (in the preferred embodiment, the last point of restrictive yarn contact is the lower yarn contact member (12)) and the point at which the yarn enters the aspirator (7). In the counterclockwise rotation of the actuator assembly, the lever (21) rotates in a plane which is approximately 9° off of the plane of rotation of the yarn snagging teeth (24). This allows a portion of the traveling yarn which is both upstream of the "point in space" and downstream of the last point of restrictive contact to cross the plane of rotation of the snagging teeth (24) and to be brought into contact with the snagging teeth (24). FIG. 7 shows the position of the yarn immediately after a snagging tooth (24) has snagged the yarn (5) and made about ⅛ of a revolution thereafter. Thus, the yarn is caught at a snag point. This snag point is an actual point on the yarn, i.e., a point with respect to which the yarn is not travelling, to be contrasted with the last point of restrictive yarn contact and the "point in space".

Although it cannot be clearly seen in FIG. 7, once the yarn (5) is snagged, that portion of the yarn (5) which is downstream of the snag point (i.e., between the snag point and the hook 23) rests upon an extension (25) of the second tube holder, the extension (25) being provided in order to keep the yarn from coming off of the snagging tooth once the snagging tooth has rotated approximately one half turn after snagging the yarn. Thus, the yarn which is downstream of the snag point is kept on top of the extension (25), and in this way the yarn is prevented from flipping off of the snagging tooth (24).

Figure 8:
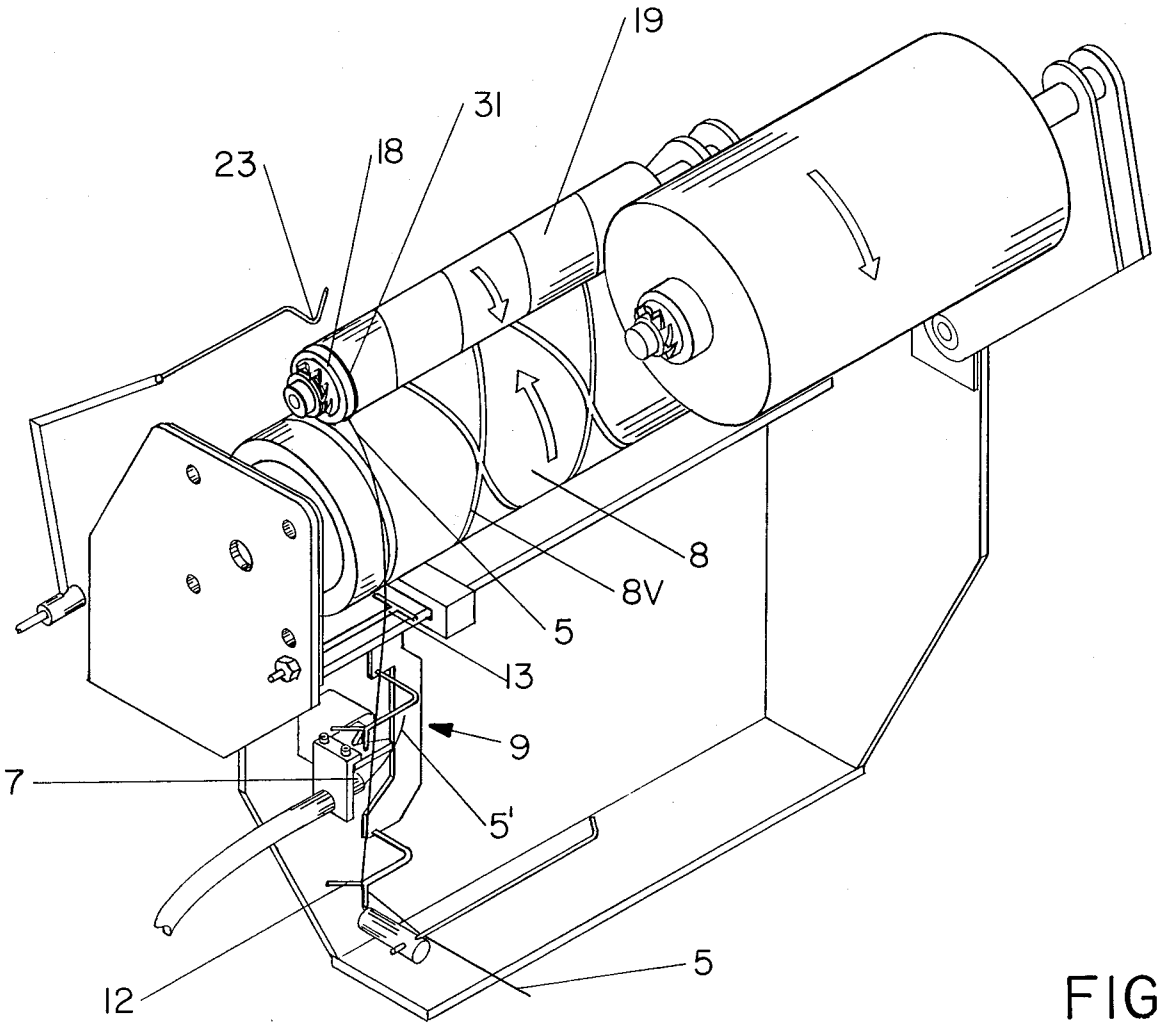

As soon as the yarn is snagged, the yarn tension downstream of the snag point increases rapidly because both the snagging teeth (24) and the aspirator (7) are competing for yarn. In the preferred process of the present invention, the yarn is being supplied (and thus wound) at about 1800 meters per minute. If the yarn strength is small enough and the equipment used powerful enough, shortly after the yarn is snagged the tension increase alone will cause the yarn to break. If the yarn is strong relative to the equipment used, it may be necessary to introduce some second yarn cutting means into the system, as is shown in FIG. 17, in which yarn retreating from the aspirator is cut by a blade (120) which is installed inside of the aspirator (7). FIG. 8 depicts the result of the yarn snagging operation, FIG. 8 illustrating the case of a yarn transfer operation being carried out on a yarn which is weak enough to break, as opposed to the yarn being cut (which is necessary for relatively strong, heavy yarns). Note the yarn end (5') going into the aspirator (7) in FIG. 8. Note also in FIG. 7 that the yarn "positions" which are upstream and downstream of the snag point are separated from one another by the yarn actuator guide (13). In FIG. 7, the yarn remains against the lower yarn contact member (12), and the yarn between the contact member (12) and the position of the hook (23) when the lever is in the active position aligns the yarn so that the yarn must contact the moving teeth (24) which are used to snag the yarn.

Figure 9:
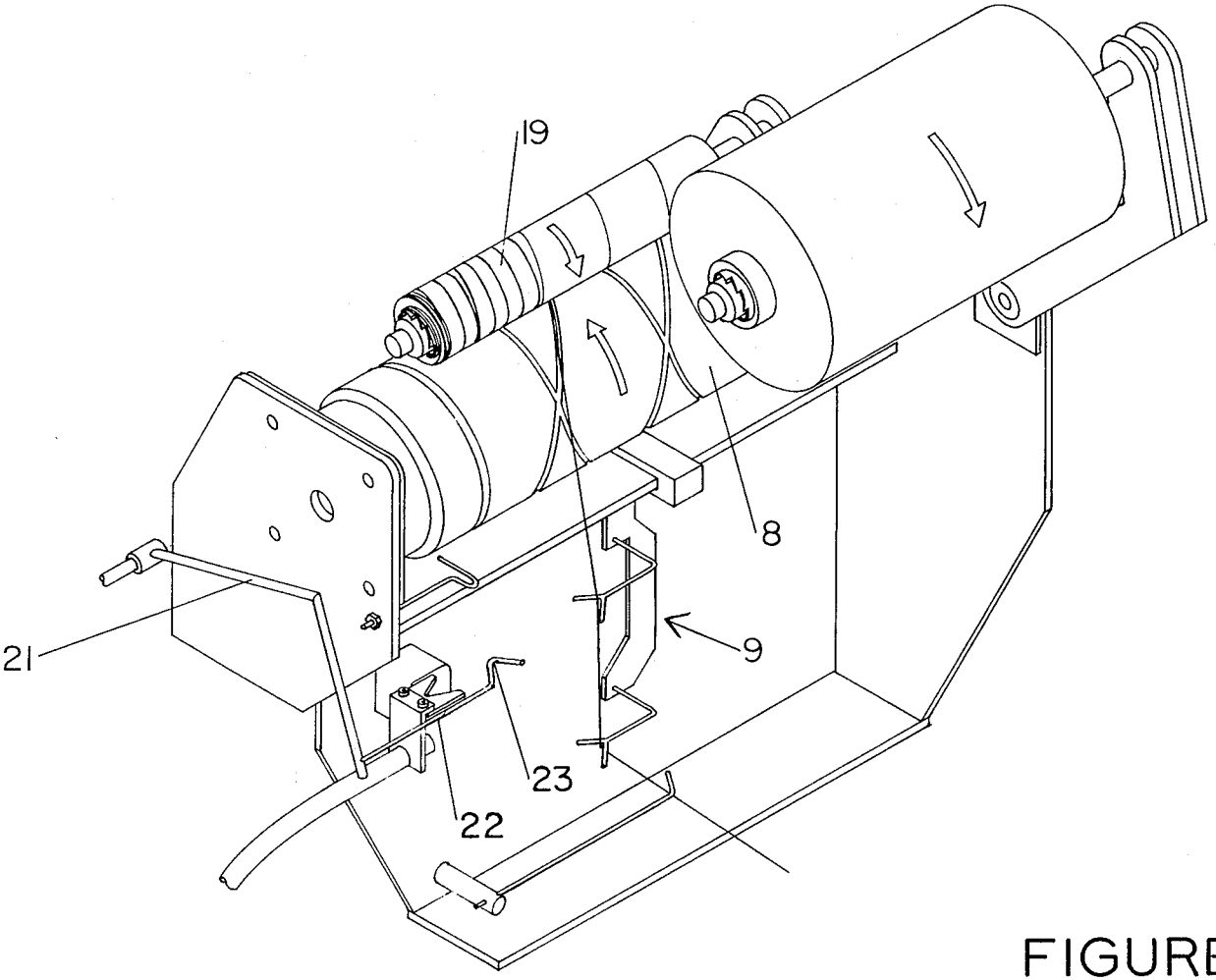

In FIG. 8, the continuously supplied yarn (5) has formed a transfer tail (31) near the end of the second take-up tube (19). The transfer tail (31) is formed on an end of the take-up tube (19), the position of the transfer tail (31) being outside of the yarn traverse range on the tube, so that the transfer tail is accessible on the full package after yarn winding is completed. Once enough yarn is wound for the transfer tail (31), the yarn catcher assembly (9) is moved across the machine, back to its nonengaged position. In so doing, the continuously supplied yarn (5), being held on lower contact member (12), is allowed to move into traverse grooves (8V) of the traverse roll (8), and the yarn begins to traverse. It is preferred that the yarn catcher assembly (9) be moved from the engaged to the nonengaged position quickly enough that the assembly (9) will not interfere with normal yarn traversal. It is also preferred to wait until a desired length of yarn has accumulated for the transfer tail before sliding the assembly (9) back to the nonengaged position. FIG. 9 shows the assembly (9) moving back to the nonengaged position, the yarn (5) entering the traverse groove (8V), and the actuator assembly (21, 22, and 23) moving back to the inactive position.

Figure 10:
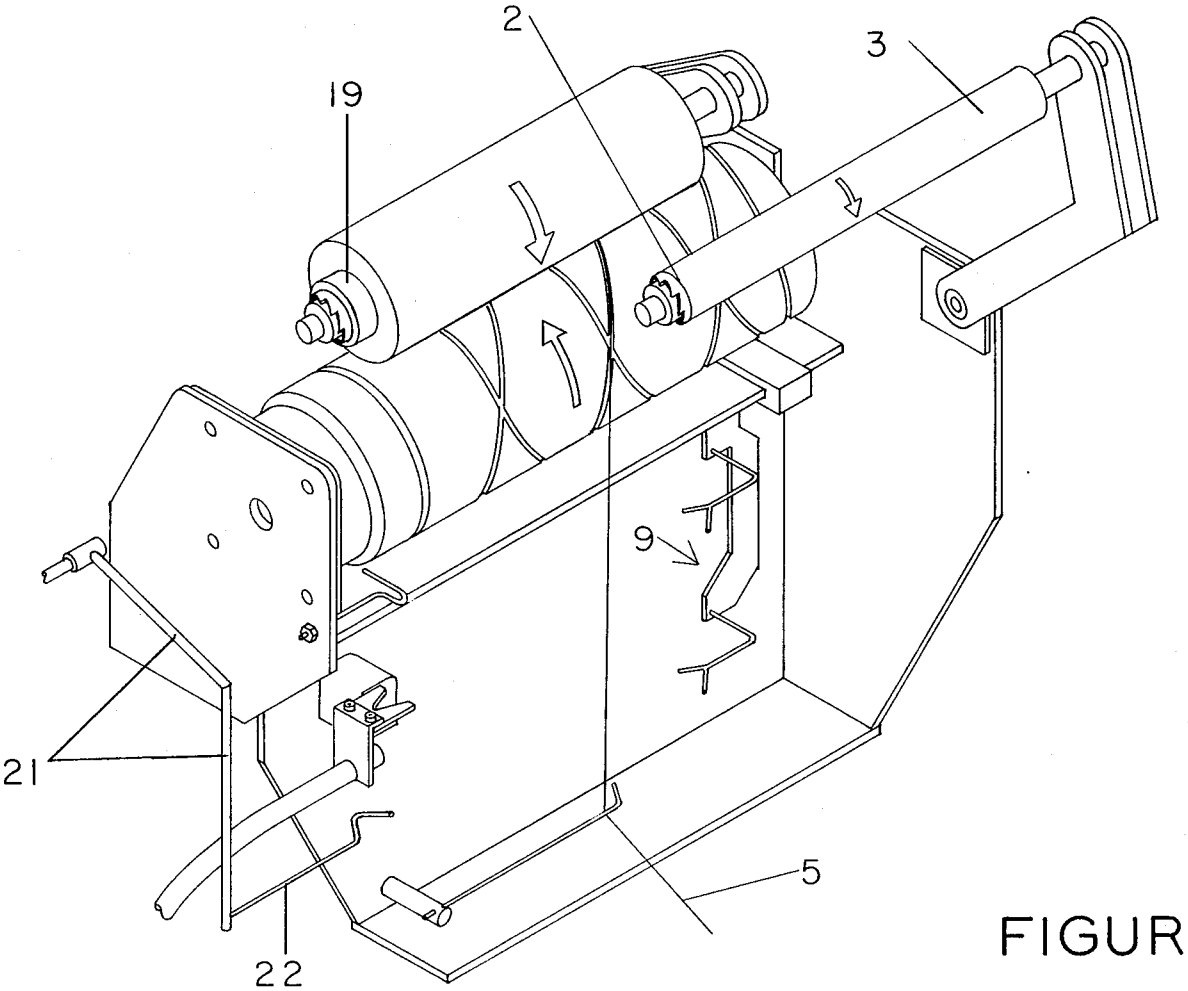

FIG. 10 illustrates a point in the process in which the second take-up tube (19) has a partially full package which is being wound thereon. Also, the first take-up tube (2), which had a full package (1) thereon in FIG. 9, has been doffed, exposing the first take-up tube holder (3). The continuously-supplied yarn (5) is traversing and the yarn catcher assembly (9) is completely removed from the yarn traversing triangle. The actuator assembly (21 and 22) has returned to the inactive position.

Figure 11:
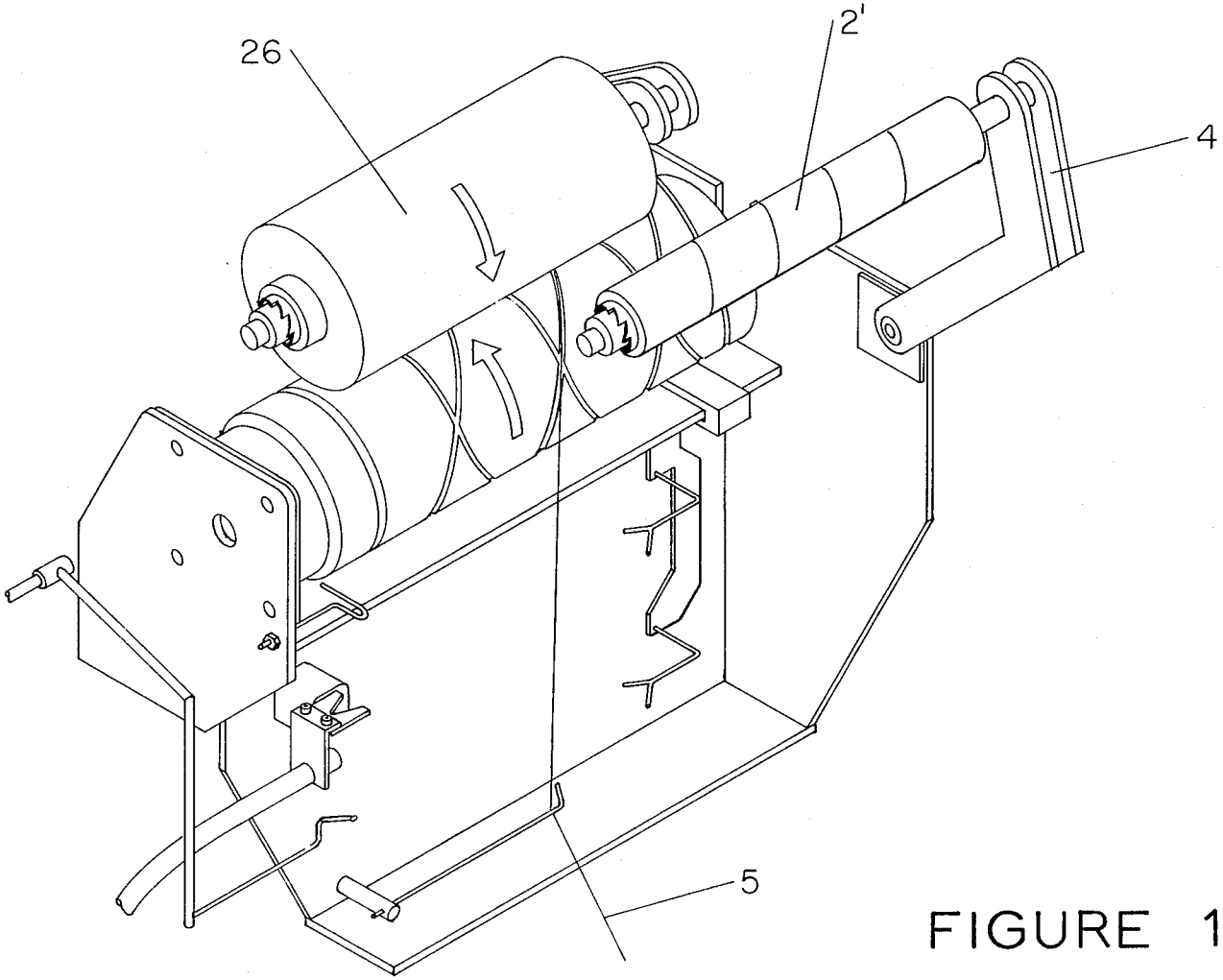

FIG. 11 illustrates a further point in the process. An operator has manually replaced the first bobbin (1), along with and the first take-up tube (2), with a fresh first take-up tube (2') which has no yarn wound thereon at this stage. Note that the second bobbin (26) has more yarn wound thereon than in FIG. 10.

Figure 12:
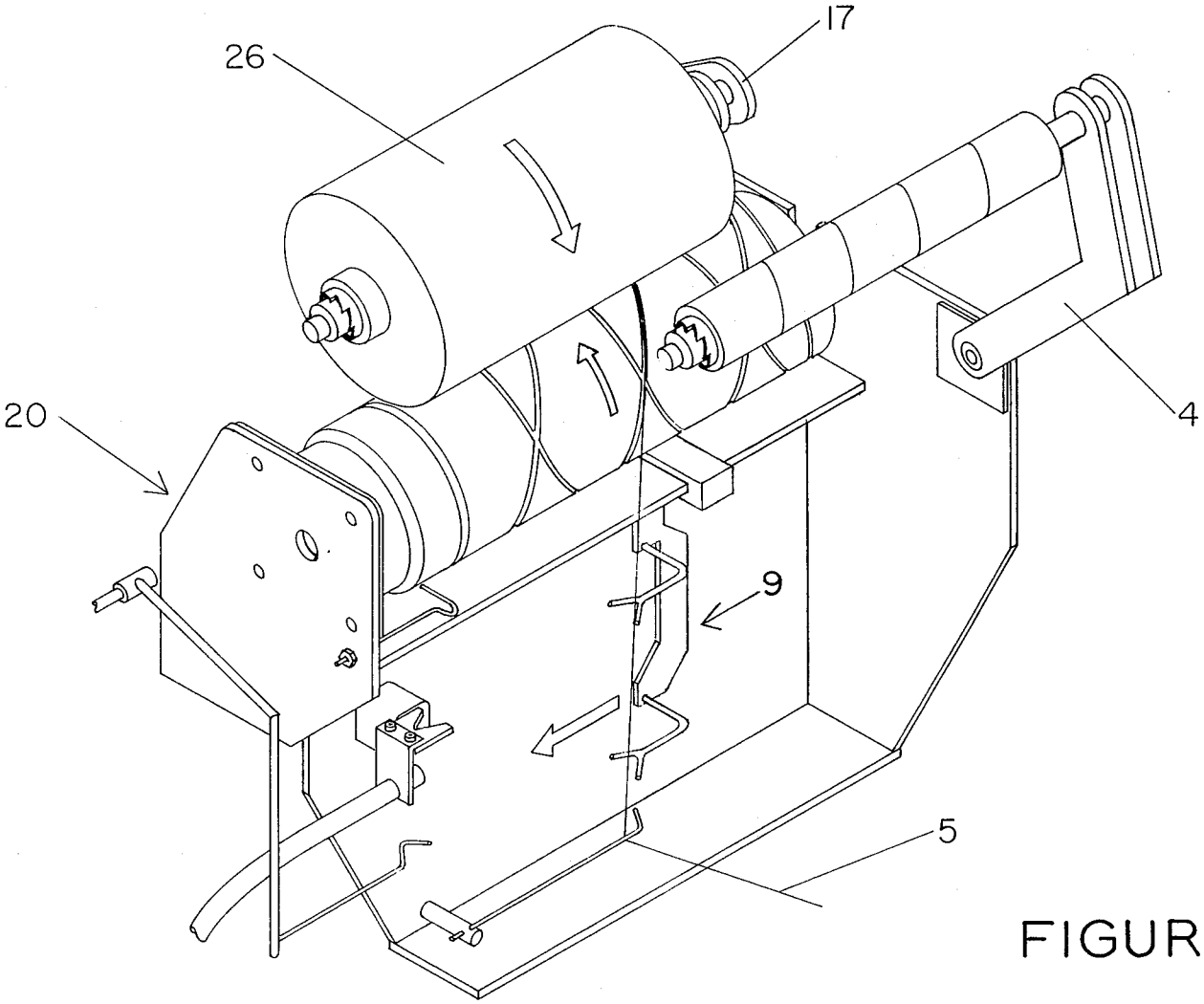

FIG. 12 is analogous to FIG. 1, except that the condition and position of both of the take-up arms (4 and 17) are reversed. FIG. 12 is included in order to illustrate the full cycle of the process. FIG. 12 shows the yarn catcher assembly (9) in transit from the nonengaged position to the engaged position, as shown in FIG. 2.

Figure 13:
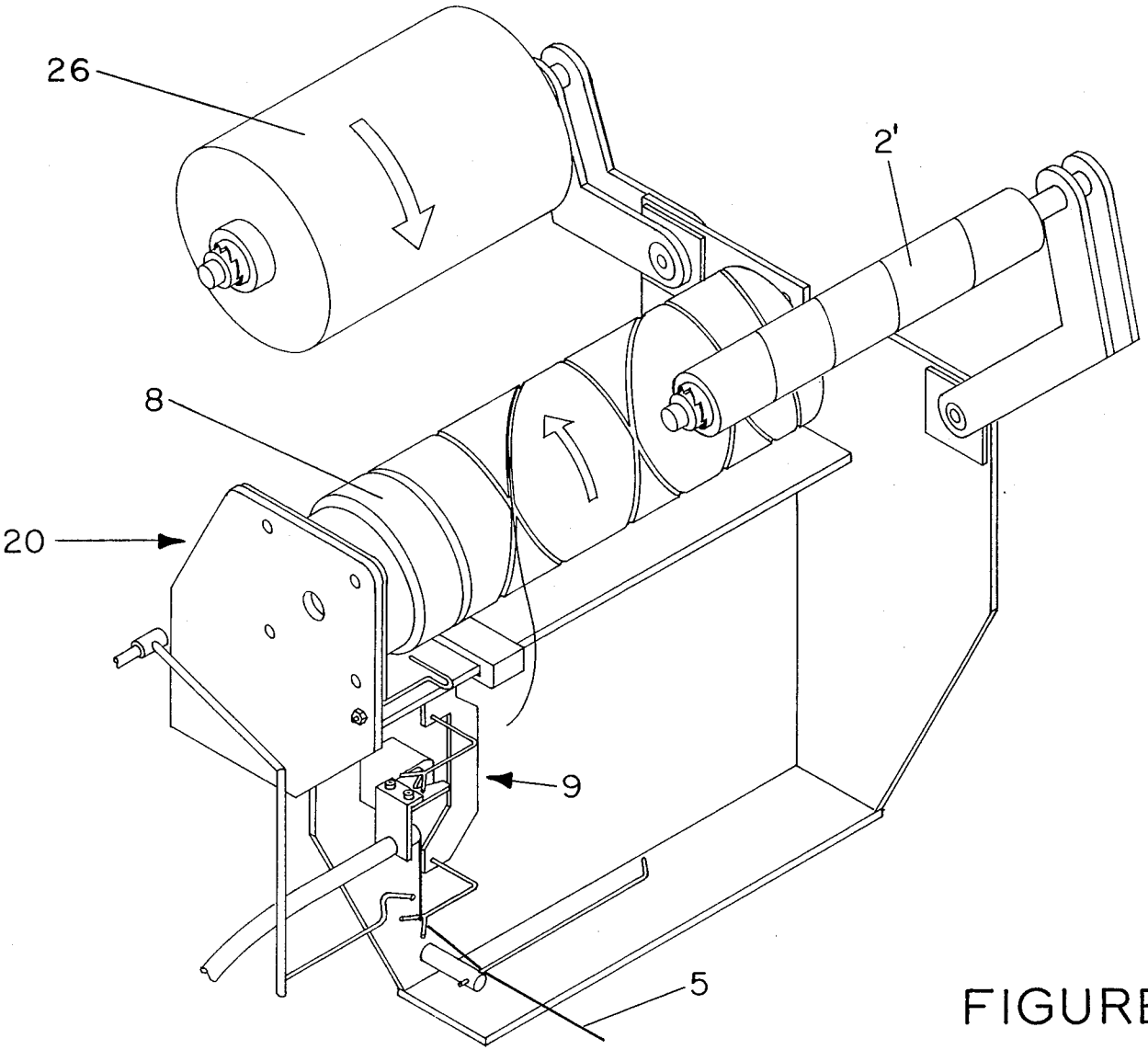

FIG. 13 is analogous to FIG. 4, except that the take-up arms are again reversed in condition and position. In FIG. 13 (as in FIG. 4), neither the bobbin (26) nor the fresh take-up tube (2') is in contact with the traverse roll (8). FIG. 13 illustrates the continuously supplied yarn (5) being aspirated and the yarn-catcher assembly (9) in the fully engaged position, as is shown in FIG. 4.

Figure 14:
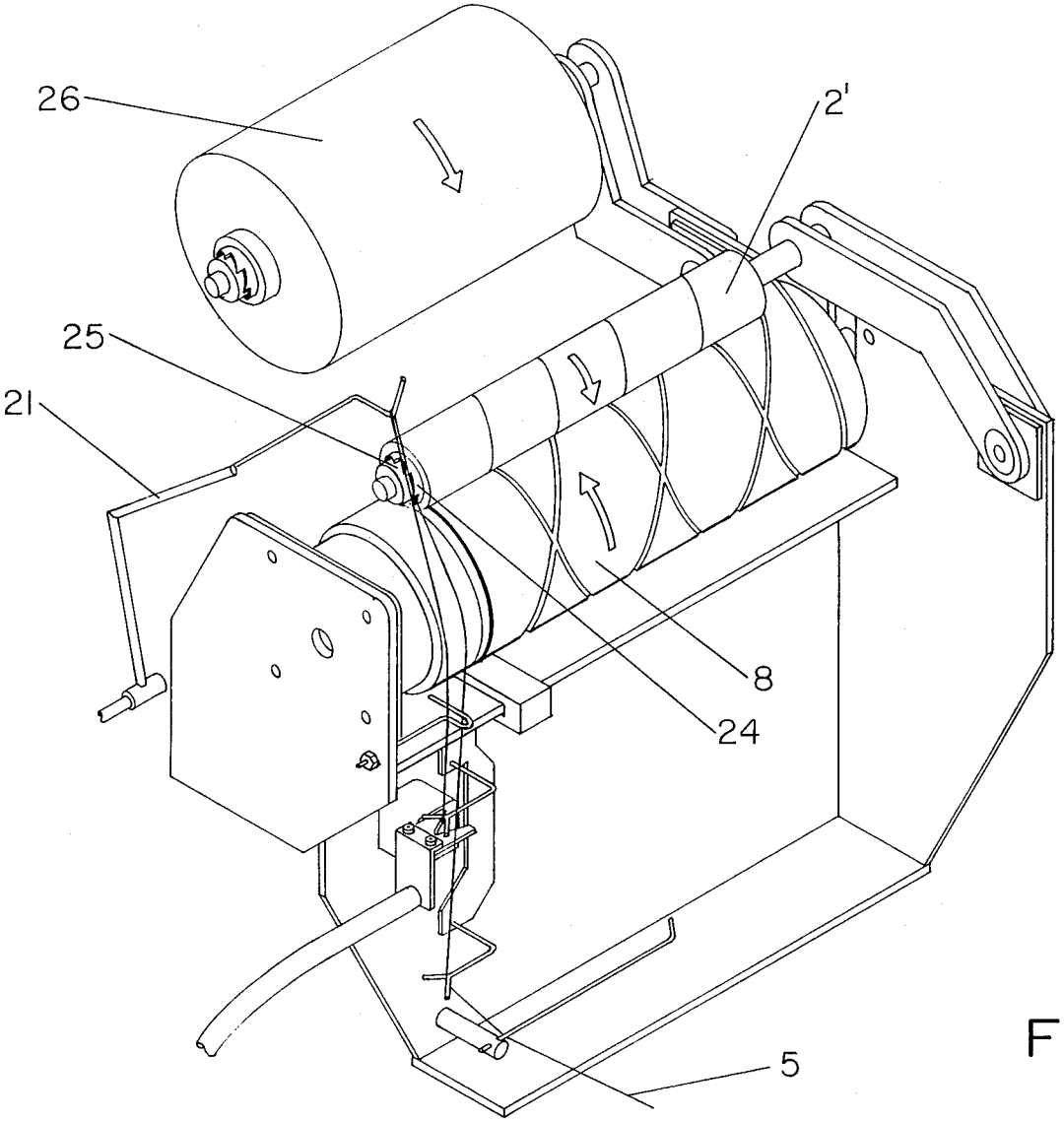

FIG. 14 is analogous to FIG. 7. In carrying the process out between points illustrated in FIG. 13 and FIG. 14, the first take-up tube (2') has been brought into contact with the traverse roll (8) and has come up to speed. The actuator lever (21) has rotated counterclockwise into the "one o'clock" position and the traveling yarn has just been snagged by a tooth (24) of the yarn snagger.

Figure 15:
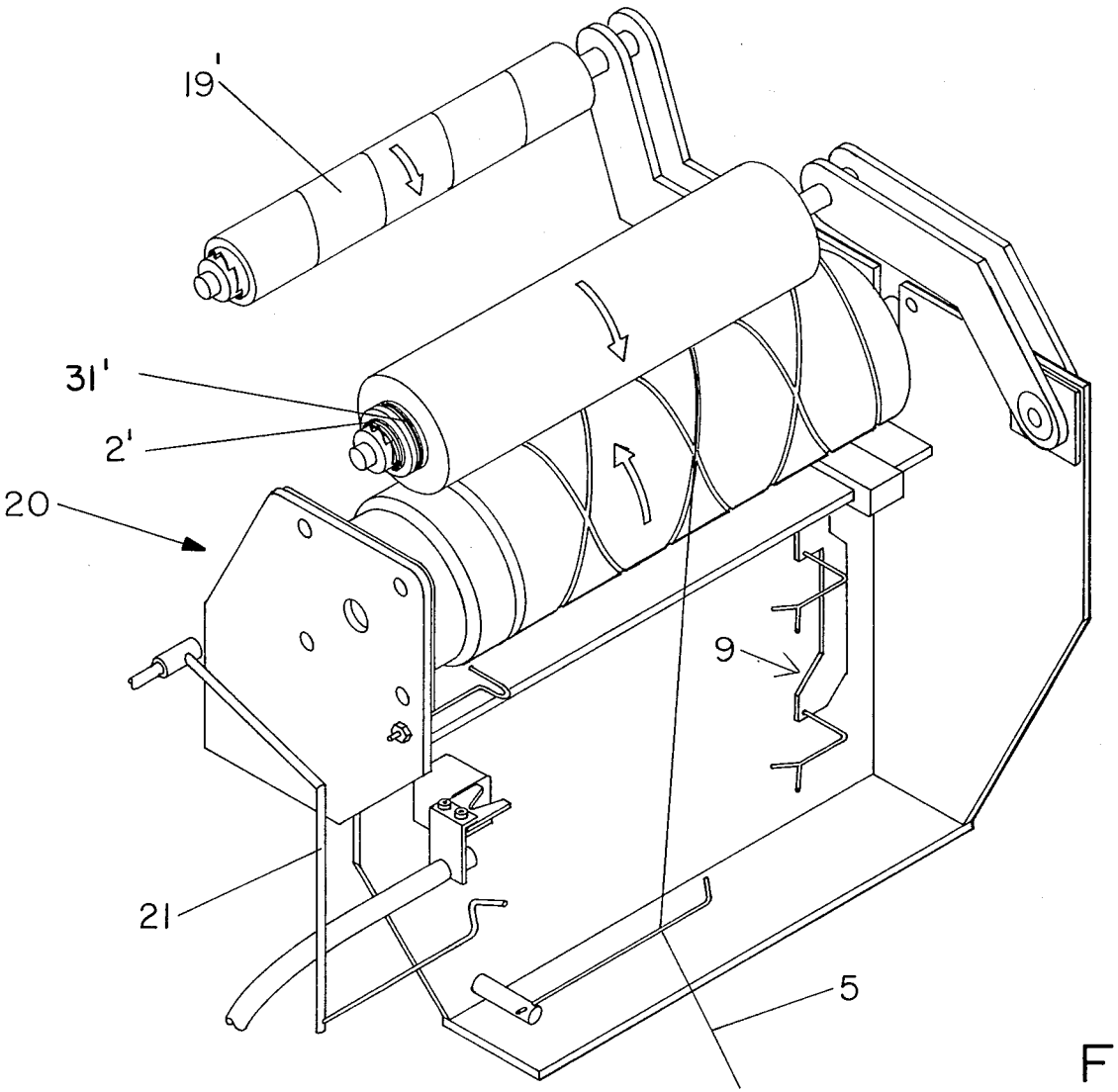
Figure 16:
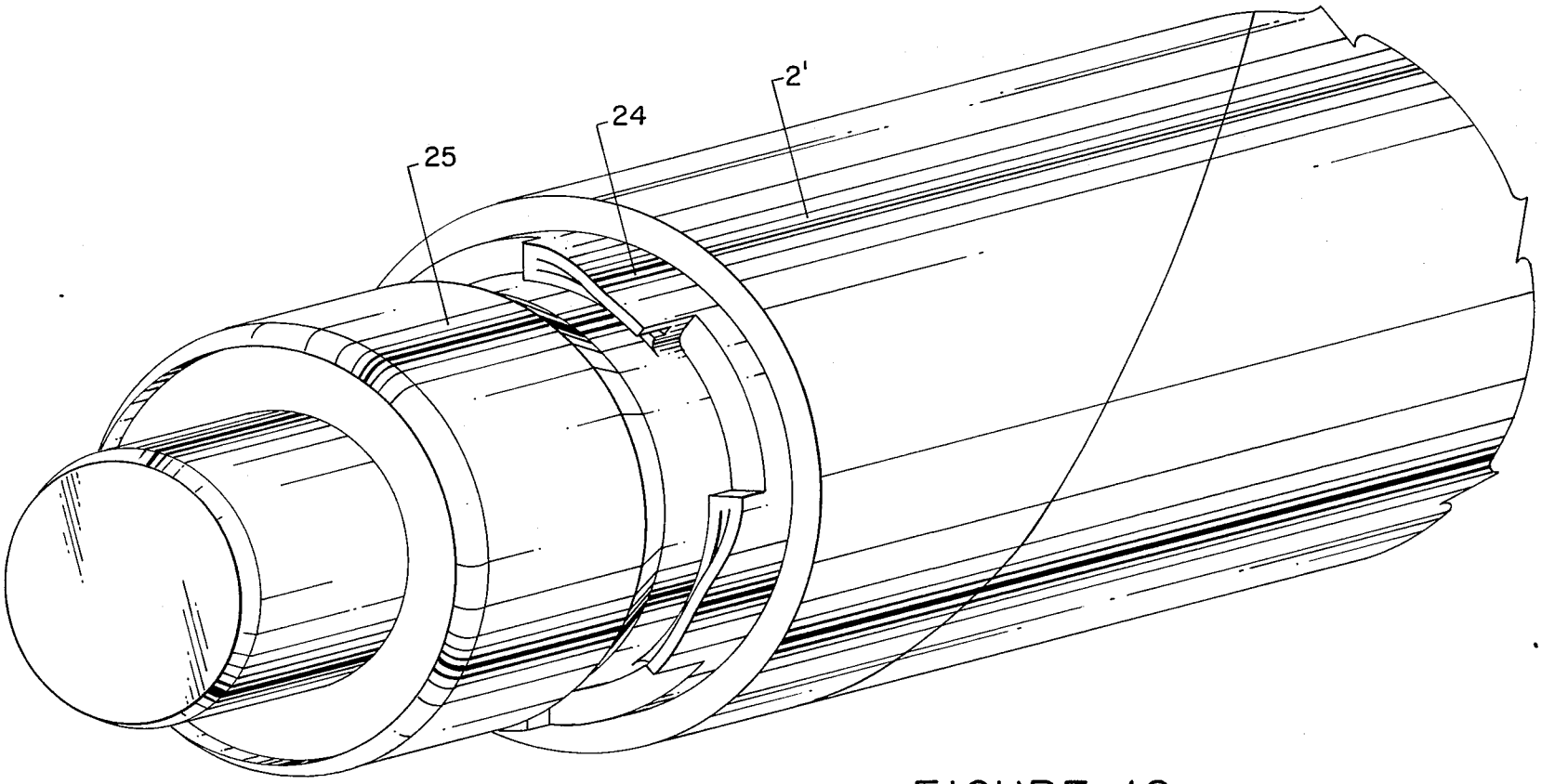
FIG. 16 illustrates an enlarged, perspective cutaway view of a portion of the apparatus of the present invention.

FIG. 15 is analogous to FIG. 10, again except that the condition and position of the take-up arms is reversed. In carrying out the process between the points illustrated in FIGS. 14 and 15, the transfer tail (31') has been wound, the yarn (5) has been cut or broken downstream of the snag point, the actuator lever (21) has returned to the inactive position, the yarn catcher assembly (9) has been moved from the engaged position to the nonengaged position, allowing the yarn to begin traversing, and as shown in FIG. 15, a partial yarn package has been built up on the fresh take-up tube (2'). In addition, the second bobbin (26) and its associated take-up tube (19) have been doffed, and a new take-up tube (19') has been donned. At this point, the process completes a single cycle. Thus, FIG. 1 represents a next point in the process, FIG. 1 then being the point at which a fresh yarn package (now, 1') has reached the desired maximum size.

In the present invention, the yarn (5) may be continuously supplied from bobbins which are attached to one another via transfer tails or the yarn may be continuously supplied from a source of filament extrusion, e.g., a melt spinning process, wet spinning process, etc. The continuously-supplied yarn is preferably run through the nip between two feed rolls which are in rotary contact with one another (the nip rolls are not shown in FIGS. 1–15). The yarn then runs under the yarn traverse guide bar (6). During winding of the yarn, the yarn runs from the guide bar (6) into the groove of the rotating traverse roll (8). While traversing, the path of yarn travel sweeps out two planes, a first plane being between the nip rolls and the traverse guide bar and a second plane between the guide bar and the traverse roll groove. These two planes together form a yarn traversing triangle. The function of the guide bar (6) is to ensure that the yarn approaches the machine (20) from the proper angle so that the operations of winding and transferring can be carried out successfully. If the nip rolls were located so that the yarn approaches the machine from the same angle as afforded by the guide bar (6), the guide bar (6) would become unnecessary. The yarn catcher catches the yarn at a point within the yarn-traversing triangle. If a traverse guide bar (6) is used (as shown in the drawings), the yarn catcher must catch the yarn at a point which is downstream of the traverse guide (6) (i.e., between the traverse guide and the traverse roll) so that the yarn need not again be threaded under the traverse guide bar (6), before the winding operation is resumed.

In the present invention, there are preferably two take-up arms. This allows for the manual doffing of a full yarn package from a first take-up tube-holder (while the take-up arm is in a first doff-donn position), followed by the donning of a new take-up tube on the first tube-holder. The phrase "first doff-donn position" refers simply to the doff-donn position of a first take-up arm. The "second doff-donn position" is simply the doff-donn position of a second take-up arm. Most preferably, both doff-donn positions are as shown in FIG. 1 and FIG. 4. Likewise, the phrase "first yarn-winding position" refers to the position of the first tubeholder during the process of winding yarn on the first tube-holder, a position which changes as the first yarn package grows in size. The same holds for the phrase: "second yarn-winding position". Most preferably, both yarn-winding positions are located vertically above the traverse roll, but neither take-up arm need be in this exact position, nor must the take-up arms contact the traverse roll in exactly the same position.

As used herein, the terms "upstream" and "downstream" are used with respect to the direction of yarn flow or movement, and are intended to refer to the yarn (5) movement from the source of continuous supply towards the machine (20). The yarn is generally being wound upon a bobbin or drawn into an aspirator. The only exception to these generalities occurs between the time at which the yarn is snagged by the rotating yarn snagger and the time at which the yarn is thereafter either cut or broken. Before this time period, the yarn has been continuously supplied from a source and has been either wound or aspirated until the yarn was snagged by the rotating yarn snagger. Immediately after that point in time at which the yarn is snagged, the yarn which is emerging from the source of continuous supply begins to bewound as a transfer tail, the winding occurring upon one end of the take-up tube. The direction of rotation of the yarn snagger also pulls yarn (which has been traveling into the aspirator, i.e., yarn between the aspirator and the snagger, this yarn being considered downstream of the snag point) back towards the snagger momentarily, until the yarn breaks or is cut.

As shown in FIG. 7, in order that the yarn is snagged, the actuator arm (22) positions the yarn so that the yarn comes into contact with one of the teeth (24) of the yarn snagger. Once the yarn is caught at a snag point, the yarn is held on the snag point (i.e., not allowed to flip off of the tooth (24) by yarn immediately downstream of the snag point being held on an extension (25) of the tube holder. The extension is believed to be an absolute necessity in the present invention, as it is believed that the yarn would flip off of the tooth (24) if there were no extension (25) on the tube holder. Both tube holders (3 and 18) have extensions (31 and 25, respectively) thereon for the purpose of winding yarn thereon during the process of snagging the yarn and winding a transfer tail.

As described herein, after the yarn is snagged, the yarn breaks by either pulling apart from a tension increase or by cutting by means of a blade. The yarns pulls apart or is cut downstream of the snag point. Yarn downstream of the snag point and upstream of the aspirator then winds around the extension (e.g., 25) or the teeth, etc. This yarn is cut away (manually) immediately before doffing the bobbin. The yarn upstream of the snag point winds around the first half inch or so of the tube. This yarn becomes the transfer tail. Preferably, there are five or more wraps of yarn constituting the transfer tail. As used herein, the phrase "breaking the yarn at a point downstream of the snag point" is meant to include both pulling the yarn apart with a tension increase as well as utilizing a blade (in the aspirator, for example) to cut the yarn at this stage of the process.

The mechanism (20) of the present invention is preferably powered, the powering means most preferably being pneumatic. The activation/deactivation of the powering means is preferably performed automatically, most preferably by a programmable controller. All of the moving parts associated with the mechanism (20) are powered by either pneumatic devices or the motor which powers the powered roll (8), the only exception being the yarn cutter (16), which is powered by an electromagnetic device. The powered roll (8) traverses the yarn. The pneumatic devices move the yarn catcher, the actuator arm, and the take-up arms. The programmable controller (not illustrated) is discussed immediately below, while the preferred pneumatic arrangement is discussed in detail immediately after the discussion of the controller.

The process of the present invention requires that the movements of the various parts of the apparatus be carried out in a specific order. Furthermore, it is most preferable to carry out the process as quickly as is practical, so that a minimal amount of yarn waste is created. However, the process steps should not become too close together in time, so that the yarn transfer process does not become subject to an undesirable number of failures.

A programmable controller is programmed to trigger solid state relays which, in turn, trigger solenoid valves which, in turn, control the pneumatic devices discussed below. It has been found that the mechanism (20) operates most efficiently with the following sequence of operations:

(a) turn on he aspirator (7) control relay;

(b) wait one second;

(c) turn on the yarn catcher (9) control relay and thereafter activate the yarn cutter;

(d) wait 4.0 seconds;

(e) turn on the relay which reverses the position of the transfer arms by first removing the full bobbin from the drive roll and thereafter applying the fresh tube to the drive roll;

(f) wait 1.5 seconds;

(g) turn off the relay which reverses the positions of the transfer arms, thereby applying the proper pressure to the drive roll with the fresh tube which contacts the roll, while simultaneously activating the rotary actuator from the nonengaged position to the engaged position;

(h) wait 1 second; and (i) deactivate the actuator arm relay and simultaneously turn off the aspirator (7) relay, as well as return the yarn catcher to the nonengaged position.

Most preferably, the programmable controller used to automate the machine is a Texas Instrument TMS 990/U 89 single board computer.

Figure 18:
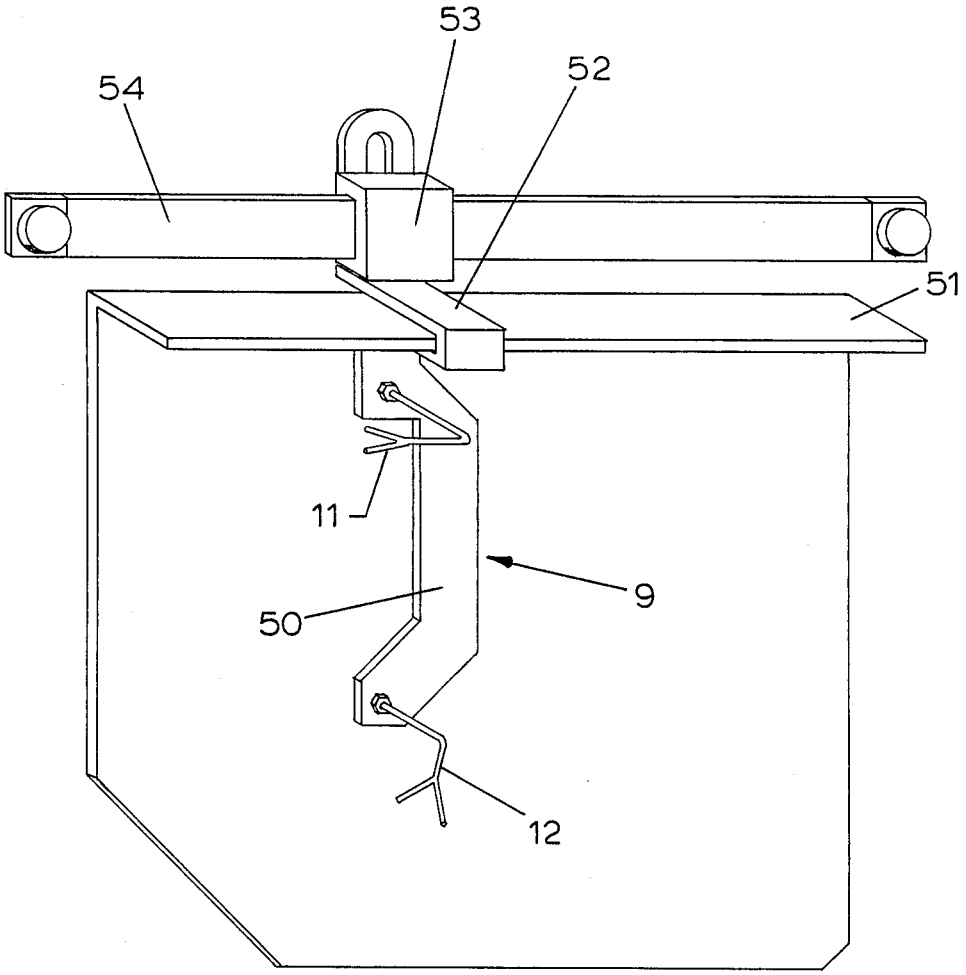
FIG. 18 illustrates an enlarged perspective view of a yarn catcher assembly (along with associated support members).

FIGS. 18, 19A, and 19B illustrate the yarn catcher assembly (9) and the mechanism by which it moves. The yarn catcher assembly (9) is comprised of a bracket (50) having an upper yarn-contact member (11) and a lower yarn-contact member (12) thereon.

FIG. 18 illustrates a detailed perspective view of the yarn catcher assembly (9) and its associated support assembly. FIG. 19A illustrates the bracket (50), the upper and lower yarn contact members (11 and 12, respectively), the guide plate (51), the guide rod (54), and the slide member (53).

FIG. 19A is a cross-sectional illustration of the yarn catcher assembly (9) and its support assembly. The bracket (50) slides on a horizontal guide plate (51). The bracket (50) has an upper surface (52) to which is bolted a slide member (53). The slide member (53) has a rectangular passageway through which a guide rod (54) is directed.

Although FIGS. 1 through 15 illustrate the yarn catcher assembly (9) in perspective view, FIGS. 1 through 15 do not illustrate the guide rod (54) and the slide member (53) because both are obscured from view by the powered tranversing roll (8) shown in FIGS. 1 through 15. However, if the mechanism (20) is viewed from the side which is opposite that shown in FIGS. 1 through 15, one may see the rod (54) and the slide (53), as well as other parts which enable the movement of the yarn catcher assembly (9). FIG. 19B illustrates, in perspective view, this "backside" view of the mechanism (20). FIG. 19B illustrates the guide rod (54) which is "behind" and slightly above the "bottom" of the powered traverse roll (8). FIG. 19B also illustrates the slide member (53), to which is attached a slide pin (62) (the pin 62 is shown only in FIG. 19A). Also shown in FIG. 19B is a lever arm (56). On its lower end, the lever arm (56) is connected to a pneumatic piston (58), the piston (58) having a piston rod (59) terminating in a connector (60), the connector (60) being pivotally connected to the lower end of the lever arm (56) with a pin (61). An upper end of the lever arm (56) has an elongated hole therein, the elongated hole allowing the lever arm (56) to pass under a cap (55) of the slide pin (62), causing the upper end of the lever arm (56) to be held between the cap (55) of the slide pin (62) and the slide member (53). The lever arm (56) slides freely between the cap (55) and the slide member (53). The lever arm (56) rotates freely around a fulcrum pin (57) (see both FIGS. 19B and 19A), the fulcrum pin (57) having a fulcrum pin support (64) which is attached to a frame plate (65), and a fulcrum pin cap (63) holds the lever arm (56) on the fulcrum pin (57). FIG. 19B illustrates a piston rod (59) in its fully extended position, which corresponds with the yarn catcher assembly (9) being in the nonengaged position. When the piston rod (59) is fully retracted by the pneumatic action within the piston (58), the lever arm (56) rotates around fulcrum pin (57), causing the slide member (53) to move the yarn catcher assembly (9) into the engaged position. FIG. 20 illustrates a perspective end-on view of the mechanism (20) from behind the device. FIG. 20 illustrates two pneumatic pistons (72 and 66) which are mounted on a horizontal base (67). The associated piston rods (68 and 69) are each attached to corresponding connecting rods (70 and 71) which in turn are connected to the "backside" of each of the take-up arms (4 and 17) with pins and connectors (not shown). Each piston rod (68 and 69) is in a fully extended position when its associated take-up arm is in the doff-donn position. Each piston rod (68 and 69) is fully retracted when its associated take-up arm (4 and 17) is holding an empty take-up tube (2 and 19) against the traverse roll (8). As a yarn package is built upon a take-up tube, the piston rod associated therewith is gradually extended, allowing the take-up arm to rise in conjunction with the buildup of yarn on the associated take-up tube.

Figure 21:
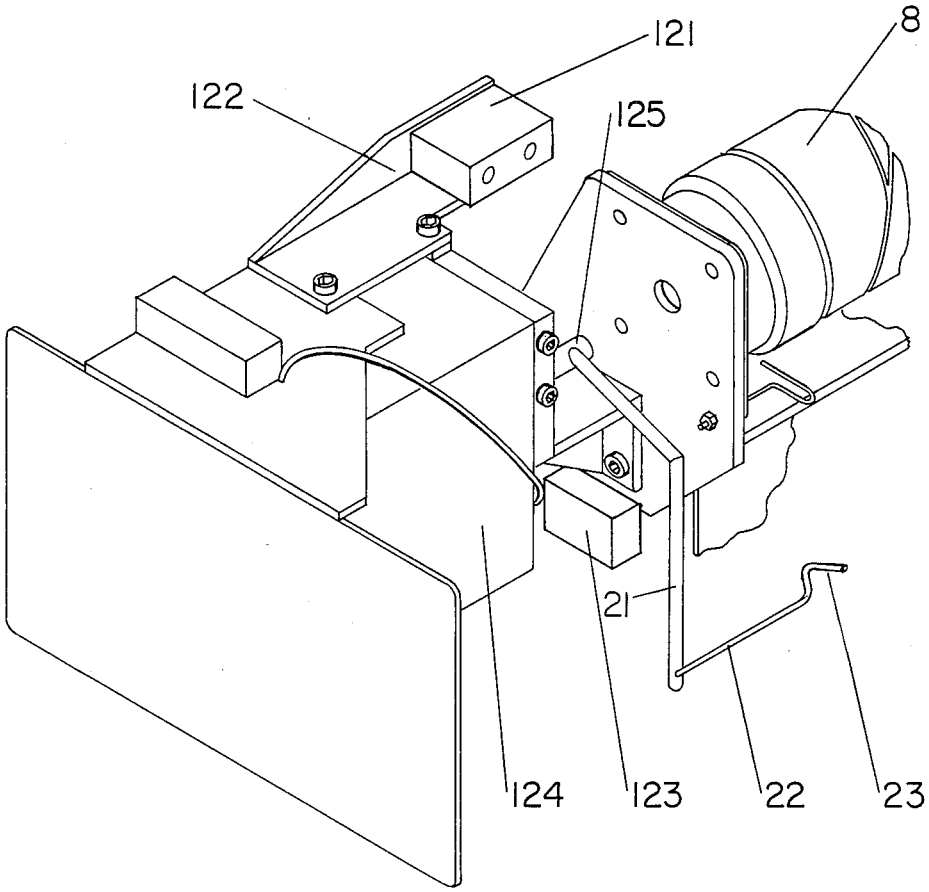
FIG. 21 is a detailed perspective view of the actuator arm and the associated assembly of members which both power and limit movement of the actuator arm.

FIG. 21 illustrates an enlarged perspective view of the actuator assembly and additional closely associated positions of the apparatus. The actuator arm (22) has a "hook" (23). The actuator arm (22) is secured to an actuator lever (21). The actuator lever rotates around an actuator pivot (125). The hydraulic rotary actuator (see in FIG. 22) is held within a housing (124). The actuator lever (21) rests upon a first rubber "bumper" (123) when the actuator assembly is in the inactive position, as shown in FIG. 21. The actuator lever (21) rests upon a second rubber "bumper" (121) when the actuator assembly is in the active position. The second bumper (121) is supported by a mounting bracket (122).

FIG. 22 is a schematic of the pneumatic system employed in the present invention. The schematic shown in FIG. 22 illustrates the pneumatic system in one of its most probable states: that state in which the yarn is being wound onto one of the take-up tubes. The circuit will first be described in the state illustrated in FIG. 22, followed by a description of the operation of the circuit during the yarn transfer process.

At bottom center of FIG. 22, the symbol SA/90 refers to a 90 PSI air which is supplied to the line extending from the symbol. Moving down this line, the symbol refers to valve number 1 designated , the valve solenoid being the first voltage signal applied in the process of automatic transfer, the solenoid of valve number 1 being activated by a potential of 120 volts applied thereto: hence the symbol . As shown, the aspirator (7) connected to valve number 1 is not operating because the solenoid has not been activated. The 90 PSI air next travels through a valve , this composite valve serving to both filter the air and reduce the output air pressure to 75 PSI, as is shown by the symbol immediately downstream of valve . The 75 PSI air emitted from valve is the air whip used to move the pneumatic pistons used in the pneumatics associated with the mechanism (20).

The 75 PSI air next goes to several different locations simultaneously, one of which is a lubricator, symbolized by , this lubricator supplying lubricant to the entire pneumatic system. The 75 PSI air also travels through the lubricator to valve (15) (designated ), then through valve (15) and on to the rotary actuator piston (designated ). This 75 PSI air is keeping the rotary actuator in the inactive position. The 75 PSI air also travels to a dead-end in valve number 4 (designated ). The 75 PSI air also travels to a pressure regulator (102) which drops the pressure to 5 PSI on its output side. The 5 PSI air from the pressure regulator (102) travels to a shuttle valve (101) and will be further discussed below. The 75 PSI air also goes to, and through, valve number 2, designated . The air passes through valve 2 and on to the yarn-catcher piston, designated . The yarn-catcher piston is shown fully extended, indicating that the yarn catcher assembly (9) is being held in the nonengaged position. A line (103), coming out of the other end of the yarn catcher piston (designated ) goes into line "A" of valve 2, this line leading to an exhaust port ("R"), rendering the pressure inside of line 103 to be 1 atmosphere (i.e., ambient). The shuttle valve (101) has a 5 PSI input from the pressure regulator (102), and the shuttle valve (101) therefore admits 5 PSI air into line 104. The shuttle valve admits pressure to line 104 from whichever line (either line 103 or the 5 PSI from pressure regulator (102)) has the greater pressure. In the schematic as shown in FIG. 22, the shuttle valve (101) allows the 5 PSI line coming from the pressure regulator (102) to go into line 104 because line 103 is open to the atmosphere (at valve 2). Thus, the 5 PSI air flows up to the binary valve (designated ), and through the binary valve on the "B" side. After passing through the binary valve, the 5 PSI air reaches a junction (105), and is then directed into both line 106 and line 107. From line 107, the 5 PSI air goes through a valve (108) and into the forward end of a first pneumatic piston (72), this piston being held in the yarn-winding position (as shown in FIG. 20). From line 106, the 5 PSI air also goes to the rearward end of a second position (66), keeping the corresponding piston rod (69) in the fully extended position, which is the doff-donn position (see piston 65 in FIG. 20). Piston (66) has line 109 connected to the forward end thereof, line 109 leading to valve 110. In the schematic, line 109 leads to an exhaust port in valve 110, leaving the 5 PSI air in line 106 holding position rod (69) in the extended position. Note that valve 110 has a bumper switch (111) which is depressed. Valve 110 is actually located at the rearward end of piston 72, and it is the movement of piston rod 68 to the retracted position which causes bumper switch 111 to be depressed. Also note that valve 108 has a bumper switch (112) which is extended. Bumper switch 112 is actually located at the rearward end of piston (66), the piston rod (69) of which is not depressing bumper switch 112 because piston rod 69 is in the extended position. Thus, one can see the operation of the pneumatic system during winding.

The computer triggers relays which in turn trigger the solenoids which in turn trigger the pneumatic valves used to directly affect the positions of the piston rods, etc., used in the mechanism (20). The computer first turns on the aspirator by activating valve number 1 (designated ). The computer then waits 1 second and then activates valve number 2 (designated ), which causes the yarn catcher assembly (9) to move to the engaged position. The retraction of the piston rod (59) associated with the yarn catcher mechanism triggers a magnetic proximity switch (designated ), which causes the electric yarn cutter to be triggered, which severs the yarn therein. The activation of valve number 2 also causes 75 PSI air to enter line (103), through which line (103) the 75 PSI air enters shuttle valve (101), the 75 PSI air shutting off the 5 PSI air side of shuttle valve (101). The 75 PSI air then exits the shuttle valve through line (104), the 75 PSI air traveling through the binary valve, and into the pistons (72 and 66). The 75 PSI air maintains the pistons in their positions as shown. The computer waits 2.5 seconds after activating valve number 2 and then activates the valve by triggering solenoid . This allows 75 PSI air to travel up through line 113 (dashed line) into the binary valve, causing valve 114 to be activated. This in turn allows 75 PSI air from line 104 to travel through the "A" side of valve 114, and causes the 75 PSI air that was in lines 106 and 107 to exhaust through "S" of valve 114. The 75 PSI air traveling through the "A" side of valve 114 moves into lines 115 and 116. From line 115, the air causes piston rod 68 to extend fully (i.e., move to the doff-donn position), thus releasing the bumper switch (111), which in turn allows the 75 PSI air in line 116 to move through valve 110 and through line 109, causing the piston rod (69) to fully retract (i.e., moving the associated transfer arm to the yarn-winding position), which in turn depresses bumper switch 112 of valve 108. After activating valve (4), the computer waits 1.5 seconds and then turns off valve (4), which exhausts the 75 PSI air in line (113) (this has no effect on valve 114). Simultaneously with the deactivation of valve (4), the computer actuates valve (15) by triggering solenoid . This causes the rotary actuator assembly (21, 22, and 23) to rotate from the inactive position to the active position. After deactivating valve 4 and activating valve (15), the computer waits 1 second and deactivates valve (15) and simultaneously deactivates valve (1) (the aspirator control valve) and valve (2), causing the yarn catcher piston rod (59) to extend (the yarn catcher assembly (9) moves from the engaged to the nonengaged position) and further causing 5 PSI air to fill lines 109, 115, and 116. Thus, piston rod (69) is held in the yarn winding position by 5 PSI air. The winding operation is continued until the yarn transfer process is desired, at which time valve 1 is again activated, etc.

The invention is not limited to the above-described specific embodiments thereof; it must be understood therefore, that the detail involved in the descriptions of these embodiments is presented for the purposes of illustration only, and that reasonable variations and modifications, which will be apparent to those skilled in the art, can be made of this invention without departing from the spirit and scope thereof.

What is claimed is:

1. A process for transferring a continuously supplied yarn traveling within a yarn traversing triangle from a first take-up tube to a second take-up tube, comprising the steps of:

(a) capturing the yarn between upper and lower yarn contact members in a yarn catcher moving from a disengaged position to an engaged position;

(b) moving said captured yarn adjacent a stationary upper yarn cutter and lower aspirator positioned between said upper and lower yarn contact members at said engaged position;

(c) cutting the yarn between the upper and lower yarn contact members, the downstream end of the yarn continuing to the first tube, the upstream end of the yarn continuing to be captured between the aspirator and the lower yarn contact member;

(d) moving a yarn hook attached to an actuator lever through the path of the captured yarn in step (c), altering the path of the yarn until the yarn contacts a yarn snagging device adjacent said second take-up tube;

(e) snagging the yarn with the yarn snagging device and breaking the yarn donwstream of the snagging device, and;

(f) returning the yarn catcher to its unengaged position, releasing the yarn to said traversing triangle.

2. Apparatus for transferring a continuously supplied yarn from a first take-up tube to a second take-up tube, comprising:

(a) a frame;

(b) a first and a second take-up arm and tube holder assembly, including a yarn snagger on each holder assembly;

(c) means mounted on said frame for alternately rotating each holder assembly;

(d) a yarn cather having an upper and lower yarn contact member and means for moving said yarn cather between a non-engaged position and an engaged position;

(e) a yarn cutter mounted to said frame between said upper and lower yarn contact members of said yarn catcher in the engaged position;

(f) a yarn aspirating means mounted upstream and adjacent said yarn cutter and between said upper and lower yarn contact members in (e); and (g) means mounted on said frame for capturing the yarn between the aspirating means and lower yarn contact member and altering the yarn path therebetween into contact with the yarn snagger on said second take-up tube.

* * * * *